US009278795B2

(12) United States Patent
Fitzwater

(10) Patent No.: US 9,278,795 B2
(45) **Date of Patent: *Mar. 8, 2016**

(54) MICROWAVE HEATING CONSTRUCT

(75) Inventor: Kelly R. Fitzwater, Lakewood, CO (US)

(73) Assignee: Graphic Packaging International, Inc., Atlanta, GA (US)

( * ) Notice: Subject to any disclaimer, the term of this patent is extended or adjusted under 35 U.S.C. 154(b) by 978 days.

This patent is subject to a terminal disclaimer.

(21) Appl. No.: 13/437,155

(22) Filed: Apr. 2, 2012

(65) Prior Publication Data

US 2012/0187114 A1 Jul. 26, 2012

Related U.S. Application Data

(63) Continuation of application No. 11/881,206, filed on Jul. 26, 2007, now Pat. No. 8,183,506.

(60) Provisional application No. 60/833,830, filed on Jul. 27, 2006.

(51) Int. Cl.
*H05B 6/80* (2006.01)
*B65D 81/34* (2006.01)

(52) U.S. Cl.
CPC ..... *B65D 81/3453* (2013.01); *B65D 2205/02* (2013.01); *B65D 2581/3406* (2013.01); *B65D 2581/3472* (2013.01); *B65D 2581/3477* (2013.01); *B65D 2581/3479* (2013.01);
(Continued)

(58) Field of Classification Search
CPC ..... B65D 81/3453; B65D 2205/02; B65D 2581/3406; B65D 2581/3472; B65D 2585/366; B65D 2581/3479; B65D 2581/3491; B65D 2581/3498; B65D 2581/3477
USPC ..... 219/725–735, 759, 762; 426/234, 107, 426/241–243, 556, 92, 122–124; 99/422, 99/DIG. 14
See application file for complete search history.

(56) References Cited

U.S. PATENT DOCUMENTS 4,260,060 A 4/1981 Faller
4,267,420 A 5/1981 Brastad
4,268,738 A 5/1981 Flautt, Jr. et al.
(Continued)

FOREIGN PATENT DOCUMENTS

EP 0 563 999 A2 10/1993
EP 0 656 301 A1 6/1995
(Continued)

OTHER PUBLICATIONS

International Search Report—PCT/US2006/001100, Jan. 13, 2006, Graphic Packaging International, Inc.
(Continued)

*Primary Examiner* — Quang Van
(74) *Attorney, Agent, or Firm* — Womble Carlyle Sandridge & Rice, LLP

(57) ABSTRACT

A multi-use construct includes a base and a plurality of walls defining an interior space. The base includes a line of disruption that defines a removable portion and a peripheral portion of the base. The construct is for being transitioned between a first configuration with the walls extending upwardly from the base, so that the construct is for containing a food item, and a second configuration with the removable portion underlying the food item and the peripheral portion overlying the food item.

24 Claims, 13 Drawing Sheets

(52) U.S. Cl.
CPC . *B65D2581/3491* (2013.01); *B65D 2581/3498* (2013.01); *B65D 2585/366* (2013.01)

(56) References Cited

U.S. PATENT DOCUMENTS

| | | | |
|---|---|---|---|
| 4,279,933 | A | 7/1981 | Austin et al. |
| 4,286,136 | A | 8/1981 | Mason, Jr. |
| 4,567,341 | A | 1/1986 | Brown |
| 4,626,641 | A | 12/1986 | Brown |
| 4,678,882 | A | 7/1987 | Bohrer et al. |
| 4,742,203 | A | 5/1988 | Brown et al. |
| 4,745,249 | A | 5/1988 | Daniels |
| 4,775,771 | A | 10/1988 | Pawlowski et al. |
| 4,810,844 | A | 3/1989 | Anderson |
| 4,835,352 | A | 5/1989 | Sasaki et al. |
| 4,865,921 | A | 9/1989 | Hollenberg et al. |
| 4,883,936 | A | 11/1989 | Maynard et al. |
| 4,888,459 | A | 12/1989 | Keefer |
| 4,890,439 | A | 1/1990 | Smart |
| 4,891,482 | A | 1/1990 | Jaeger et al. |
| 4,894,247 | A | 1/1990 | Fong |
| 4,894,503 | A | 1/1990 | Wendt |
| 4,896,009 | A | 1/1990 | Pawlowski |
| 4,916,280 | A | 4/1990 | Havette |
| 4,927,991 | A | 5/1990 | Wendt et al. |
| 4,933,193 | A | 6/1990 | Fisher |
| 4,936,935 | A | 6/1990 | Beckett |
| 4,940,867 | A | 7/1990 | Peleg |
| 4,962,293 | A | 10/1990 | Lackey |
| 4,963,424 | A | 10/1990 | Beckett |
| 4,968,865 | A | 11/1990 | Seaborne et al. |
| 5,008,507 | A | 4/1991 | Pesheck et al. |
| 5,034,234 | A | 7/1991 | Andreas |
| 5,039,364 | A | 8/1991 | Beckett et al. |
| 5,041,325 | A | 8/1991 | Larson et al. |
| 5,053,594 | A | 10/1991 | Thota et al. |
| 5,081,330 | A | 1/1992 | Brandberg et al. |
| 5,084,601 | A | 1/1992 | Andreas |
| 5,096,723 | A | 3/1992 | Turpin |
| 5,117,078 | A | 5/1992 | Beckett |
| 5,140,119 | A | 8/1992 | Brown et al. |
| 5,164,562 | A | 11/1992 | Huffman et al. |
| 5,177,332 | A | 1/1993 | Fong |
| 5,213,902 | A | 5/1993 | Beckett |
| 5,217,768 | A | 6/1993 | Walters et al. |
| 5,221,419 | A | 6/1993 | Beckett |
| 5,231,268 | A | 7/1993 | Hall et al. |
| 5,239,153 | A | 8/1993 | Beckett |
| 5,247,149 | A | 9/1993 | Peleg |
| 5,256,846 | A | 10/1993 | Walters |
| 5,260,070 | A | 11/1993 | Peleg |
| 5,260,537 | A | 11/1993 | Beckett |
| 5,266,386 | A | 11/1993 | Beckett |
| 5,294,763 | A | 3/1994 | Chamberlain et al. |
| RE34,683 | E | 8/1994 | Maynard et al. |
| 5,334,820 | A | 8/1994 | Risch |
| 5,340,436 | A | 8/1994 | Beckett |
| 5,354,973 | A | 10/1994 | Beckett |
| 5,389,767 | A | 2/1995 | Dobry |
| 5,405,663 | A | 4/1995 | Archibald et al. |
| 5,410,135 | A | 4/1995 | Pollart et al. |
| 5,412,187 | A | 5/1995 | Walters et al. |
| 5,424,517 | A | 6/1995 | Habeger et al. |
| 5,484,984 | A | 1/1996 | Gics |
| 5,510,132 | A | 4/1996 | Gallo, Jr. |
| 5,519,195 | A | 5/1996 | Keefer et al. |
| 5,543,606 | A | 8/1996 | Gics |
| 5,565,125 | A | 10/1996 | Parks |
| 5,585,027 | A | 12/1996 | Young |
| 5,628,921 | A | 5/1997 | Beckett |
| 5,672,407 | A | 9/1997 | Beckettt |
| 5,688,427 | A | 11/1997 | Gallo, Jr. |
| 5,698,127 | A | 12/1997 | Lai et al. |
| 5,759,422 | A | 6/1998 | Schmelzer et al. |
| 5,770,840 | A | 6/1998 | Lorence |
| 5,800,724 | A | 9/1998 | Habeger et al. |
| 5,864,123 | A | 1/1999 | Keefer |
| 5,900,264 | A | 5/1999 | Gics |
| 5,910,268 | A | 6/1999 | Keefer |
| 5,948,308 | A | 9/1999 | Wischusen, III |
| 6,054,698 | A | 4/2000 | Mast |
| 6,114,679 | A | 9/2000 | Lai et al. |
| 6,133,560 | A | 10/2000 | Zeng et al. |
| 6,137,099 | A | 10/2000 | Hamblin |
| 6,150,646 | A | 11/2000 | Lai et al. |
| 6,158,589 | A | 12/2000 | Smith et al. |
| 6,168,812 | B1 | 1/2001 | Paulucci |
| 6,204,492 | B1 | 3/2001 | Zeng et al. |
| 6,251,451 | B1 | 6/2001 | Zeng |
| 6,359,272 | B1 | 3/2002 | Sadek et al. |
| 6,414,290 | B1 | 7/2002 | Cole et al. |
| 6,433,322 | B2 | 8/2002 | Zeng et al. |
| 6,455,827 | B2 | 9/2002 | Zeng |
| 6,501,059 | B1 | 12/2002 | Mast |
| 6,534,755 | B1 | 3/2003 | Paulucci |
| 6,552,315 | B2 | 4/2003 | Zeng et al. |
| 6,559,430 | B2 | 5/2003 | Monforton et al. |
| 6,677,563 | B2 | 1/2004 | Lai |
| 6,717,121 | B2 | 4/2004 | Zeng et al. |
| 6,765,182 | B2 | 7/2004 | Cole et al. |
| 7,019,271 | B2 | 3/2006 | Wnek |
| 7,514,659 | B2 | 4/2009 | Lafferty |
| 8,008,609 | B2 | 8/2011 | Noyelle et al. |
| 8,071,924 | B2 | 12/2011 | Lafferty |
| 8,183,506 | B2 * | 5/2012 | Fitzwater ..... 219/730 |
| 2001/0017297 | A1 | 8/2001 | Zeng et al. |
| 2001/0021405 | A1 | 9/2001 | Zeng |
| 2002/0144996 | A1 | 10/2002 | Zeng et al. |
| 2003/0010777 | A1 | 1/2003 | Milgrom |
| 2003/0085224 | A1 | 5/2003 | Tsontzidis et al. |
| 2003/0111463 | A1 | 6/2003 | Lai |
| 2003/0116562 | A1 | 6/2003 | Halimi et al. |
| 2003/0206997 | A1 | 11/2003 | Winkelman et al. |
| 2004/0149746 | A1 | 8/2004 | Hoese et al. |
| 2004/0173607 | A1 | 9/2004 | Blankenbeckler et al. |
| 2004/0232213 | A1 | 11/2004 | Pope |
| 2005/0042360 | A1 * | 2/2005 | Tiffany et al. ..... 426/637 |
| 2005/0205565 | A1 | 9/2005 | Cole et al. |
| 2005/0230383 | A1 | 10/2005 | Romeo |
| 2006/0049190 | A1 | 3/2006 | Middleton |
| 2006/0113300 | A1 | 6/2006 | Wnek |
| 2006/0157480 | A1 | 7/2006 | Lafferty |
| 2006/0289521 | A1 | 12/2006 | Bohme et al. |
| 2007/0039951 | A1 | 2/2007 | Cole |
| 2007/0056962 | A1 * | 3/2007 | Hopkins et al. ..... 219/730 |
| 2007/0087090 | A1 | 4/2007 | Russell et al. |
| 2007/0228036 | A1 | 10/2007 | Noyelle et al. |
| 2007/0251943 | A1 | 11/2007 | Wnek et al. |
| 2008/0023469 | A1 | 1/2008 | Fitzwater |
| 2009/0120929 | A1 | 5/2009 | Lafferty |
| 2009/0206074 | A1 | 8/2009 | Schneider |
| 2010/0038359 | A1 | 2/2010 | Laubhan |
| 2012/0000905 | A1 | 1/2012 | Noyelle et al. |
| 2012/0100265 | A1 | 4/2012 | Lafferty |

FOREIGN PATENT DOCUMENTS

| | | | |
|---|---|---|---|
| EP | 0 970 895 | A1 | 1/2000 |
| EP | 1 840 047 | A1 | 10/2007 |
| FR | 2 828 394 | A1 | 2/2003 |
| GB | 2 368 507 | A | 5/2002 |
| JP | 62-191682 | | 12/1987 |
| JP | 63-16600 | | 1/1988 |
| JP | 64-20331 | | 2/1989 |
| JP | 1-97107 | | 6/1989 |
| JP | 09132279 | A | 5/1997 |
| JP | 09185991 | A | 7/1997 |
| WO | WO 89/04585 | A1 | 5/1989 |
| WO | WO 92/00899 | A1 | 1/1992 |
| WO | WO 97/11010 | A1 | 3/1997 |
| WO | WO 03/066435 | A2 | 8/2003 |
| WO | WO 2005/085091 | A2 | 9/2005 |
| WO | WO 2006/076501 | A1 | 7/2006 |
| WO | WO 2006/130789 | A1 | 12/2006 |

(56) References Cited

FOREIGN PATENT DOCUMENTS

| | | | |
|---|---|---|---|
| WO | WO 2007/123611 | A1 | 11/2007 |
| WO | WO 2008/014377 | A2 | 1/2008 |
| WO | WO 2008/052096 | A1 | 5/2008 |
| WO | WO 2008/115272 | A2 | 9/2008 |
| WO | WO 2010/019758 | A2 | 2/2010 |

OTHER PUBLICATIONS

Written Opinion—PCT/US2006/001100, Jan. 13, 2006, Graphic Packaging International, Inc.
International Search Report—PCT/US2007/006703, Mar. 16, 2006, Graphic Packaging International, Inc.
Written Opinion—PCT/US2007/006703, Mar. 16, 2006, Graphic Packaging International, Inc.
International Search Report—PCT/US2007/074427, Jul. 26, 2007, Graphic Packaging International, Inc.
Written Opinion—PCT/US2007/074427, Jul. 26, 2007, Graphic Packaging International, Inc.
International Search Report—PCT/US2009/053675, Aug. 13, 2009, Graphic Packaging International, Inc.
Written Opinion—PCT/US2009/053675, Aug. 13, 2009, Graphic Packaging International, Inc.
Notice of Allowance and Fee(s) Due dated Jun. 12, 2014 for U.S. Appl. No. 13/186,728.
European Search Report for EP 14 00 1647.8 dated Jul. 31, 2014.
Notice of Allowance and Fee(s) Due dated Nov. 9, 2012 for U.S. Appl. No. 12/583,079.
Notification of Reason for Refusal, for JP 2009-502840 dated Jul. 4, 2011.
International Preliminary Report on Patentability—PCT/US2006/001100, Apr. 27, 2007, Graphic Packaging International, Inc.
International Preliminary Report on Patentability—PCT/US2007/074427, Jan. 27, 2009, Graphic Packaging International, Inc.
International Preliminary Report on Patentability—PCT/US2007/006703, Sep. 30, 2008, Graphic Packaging International, Inc.
International Preliminary Report on Patentability—PCT/US2009/053675, Feb. 15, 2011, Graphic Packaging International, Inc.

* cited by examiner

MICROWAVE HEATING CONSTRUCT

CROSS-REFERENCE TO RELATED APPLICATIONS

This application is a continuation of U.S. patent application Ser. No. 11/881,206, filed Jul. 26, 2007, which claims the benefit of U.S. Provisional Application No. 60/833,830, filed Jul. 27, 2006, both of which are incorporated by reference herein in their entirety.

TECHNICAL FIELD

The present invention relates to blanks, constructs, and systems for containing, heating, browning, and/or crisping a food item in a microwave oven.

BACKGROUND

Microwave ovens provide a convenient means for heating a variety of food items, including dough-based products such as pizzas and pies. However, microwave ovens tend to cook such items unevenly and are unable to achieve the desired balance of thorough heating and a browned, crisp crust. Many commercially available packages attempt to brown and/or crisp the bottom surface of the food item without addressing the need to brown and/or crisp the crust or dough on the top or edges of the food item. Thus, there is a need for a system that provides the desired degree of heating, browning, and/or crisping of both the bottom and top surfaces of the crust or dough of a food item.

SUMMARY

The present invention relates generally to various blanks, packages, containers, trays, pans, cards, disks, or any combination thereof (sometimes collectively "constructs"), various blanks for forming such constructs, methods of making such constructs, and methods of using such constructs to heat, brown, and/or crisp a food item in a microwave oven.

The various constructs of the present invention include one or more reconfigurable panels or portions that are adapted to contain the food item, for example, during shipping, sale, and storage, and to provide browning and/or crisping of the food item when heated in a microwave oven. Thus, for example, the construct may be a container that transforms into a sleeve, heating disk, pouch, or any other suitable structure. In one example, the construct comprises a package or container that is capable of readily being transformed into a card or disk for browning and/or crisping the bottom surface of a food item, for example, the lower crust of a pizza or pie, and a cover, lid, or ring for simultaneously browning and/or crisping another portion of the food item, for example, the top surface or upper edges of a pizza or pie. The constructs may include various features that enhance the heating, browning, and/or crisping of the food item including, but not limited to, microwave energy interactive elements, apertures, venting channels, elevating elements, insulating elements, or any combination thereof.

According to various aspects of the invention, the transformation from a storage receptacle or container to a heating, browning, and/or crisping construct may comprise separating one or more portions of the container, folding one or more portions of the container or portions removed therefrom, inverting one or more portions of the container or portions removed therefrom, any other transformation, or any combination of transformations. In one particular aspect, the transformation comprises providing a package including a microwave energy interactive element overlying at least a portion of a surface thereof, separating a heating, browning, and/or crisping card or disk from the container, placing the food item on the card or disk with the microwave energy interactive element facing the food item, inverting the remainder of the construct, and configuring the inverted portion to overlie the upper crust of the food item with the microwave energy interactive element facing inwardly toward the crust. In doing so, the heating, browning, and/or crisping of both the bottom surface and the top surface of the crust of the food item may be enhanced. The construct also may include side walls that include a microwave energy interactive element that may enhance the heating, browning, and/or crisping of the sides of the food item.

In one particular aspect, a blank for forming a construct, comprises a main panel including a removable panel at least partially defined by a line of disruption, a plurality of side panels extending from the main panel along respective fold lines, and a microwave energy interactive element overlying at least a portion of the main panel. The main panel may include a peripheral portion that circumscribes the removable panel. The blank also may include a tab defined by a line of disruption that initiates and terminates proximate the removable panel.

In one variation of this aspect, the main panel is substantially square in shape, and the plurality of side panels includes a first pair of opposed side panels that are substantially rectangular in shape and a second pair of opposed side panels that are substantially trapezoidal in shape. The blank may include a pair of end panels extending from opposed ends of each side panel of the first pair of side panels.

In another variation, the plurality of side panels includes a first side panel including a pair of locking tabs extending from opposed ends of the first side panel, and a second side panel including a pair of receiving slits. Each receiving slit is adapted to receive one locking tab of the pair of locking tabs.

In another variation, the plurality of panels includes a first set of side panels and a second set of side panels extending from the main panel in an alternating relationship, each side panel of the first set of side panels includes a pair of locking tabs, and each side panel of the second set of side panels includes a pair of receiving slits adapted to receive the respective adjacent locking tabs.

In one particular example, the main panel is substantially octagonal in shape, the first set of side panels includes four side panels, and the second set of side panels includes four side panels.

In this and other aspects of the invention, the microwave energy interactive element may comprise a susceptor. If desired, the microwave energy interactive element may circumscribe a plurality of microwave energy transparent areas.

In another aspect, a construct for containing, heating, browning, and/or crisping a food item comprises a base and a plurality of walls defining an interior space, and a microwave energy interactive material overlying at least a portion of the base proximate the interior space. The base may include a removable panel defined at least partially by a line of disruption and a peripheral area circumscribing the removable panel.

In one variation, the construct is adapted to receive a food item seated on the base within the interior space. In another variation, the microwave energy interactive material overlies at least a portion of the removable panel, the removable panel is adapted to be separated from the construct, and with the removable panel separated from the construct, the removable panel is adapted to receive at least a portion of the food item intended to be browned and/or crisped.

In another variation, the microwave energy interactive material overlies at least a portion of the peripheral area of the base, the food item includes a peripheral area intended to be browned and/or crisped, and in a configuration with the walls extending downwardly from the base, the construct is adapted to receive the food item within the interior space with the microwave energy interactive material overlying the peripheral area of the food item.

In one particular example, the base is substantially square in shape, and the plurality of walls includes a first pair of opposed walls that are substantially rectangular in shape and a second pair of opposed walls that are substantially trapezoidal in shape. The blank further comprises a pair of end panels extending from opposed ends of each wall of the first pair of walls.

In another particular example, the plurality of walls includes a first set of walls and a second set of walls in an alternating relationship extending from the main panel, each wall of the first set of walls includes a pair of locking tabs, and each wall of the second set of walls includes a pair of receiving slits adapted to receive the respective adjacent locking tabs.

In another aspect, a multi-use construct comprises a base and a plurality of walls defining an interior space. The base includes a removable panel defined by a line of disruption. The construct also comprises a microwave energy interactive element overlying at least a portion of the base. The microwave energy interactive element defines at least a portion of an interior surface of the construct. In a first configuration with the walls extending upwardly from the base, the construct is adapted to receive and contain a food item within the interior space. In a second configuration with the removable panel separated from the base, the removable panel is adapted to receive at least a portion of the food item. In a third configuration, the removable panel is separated from the base, thereby forming a remaining portion of the construct. The remaining portion of the construct is adapted to be inverted relative to the first configuration and positioned over the food item.

In one variation, the removable panel has a first side at least partially comprising at least a portion of the microwave energy interactive element, the food item has a surface intended to be browned and/or crisped, and in the second configuration, the surface of the food item intended to be browned and/or crisped is in a superposed, facing relationship with the first side of the removable panel.

In another variation, the base includes a peripheral area circumscribing the removable panel, the microwave energy interactive element overlies at least a portion of the peripheral area, and in the third configuration, the peripheral area overlies a portion of the food item intended to be browned and/or crisped.

In yet another variation, the removable panel separated from the base forms an opening in the base, and in the third configuration, the opening overlies a portion of the food item not intended to be browned and/or crisped.

Other features, aspects, and embodiments of the invention will be apparent from the following description and accompanying figures.

BRIEF DESCRIPTION OF THE DRAWINGS

The description refers to the accompanying drawings in which like reference characters refer to like parts throughout the several views, and in which.

DESCRIPTION

The present invention may be illustrated further by referring to the figures. For purposes of simplicity, like numerals may be used to describe like features. It will be understood that where a plurality of similar features are depicted, not all of such features necessarily are labeled on each figure. It also will be understood that various components used to form the blanks and constructs of the present invention may be interchanged. Thus, while only certain combinations are illustrated herein, numerous other combinations and configurations are contemplated hereby.

Figure 1A:
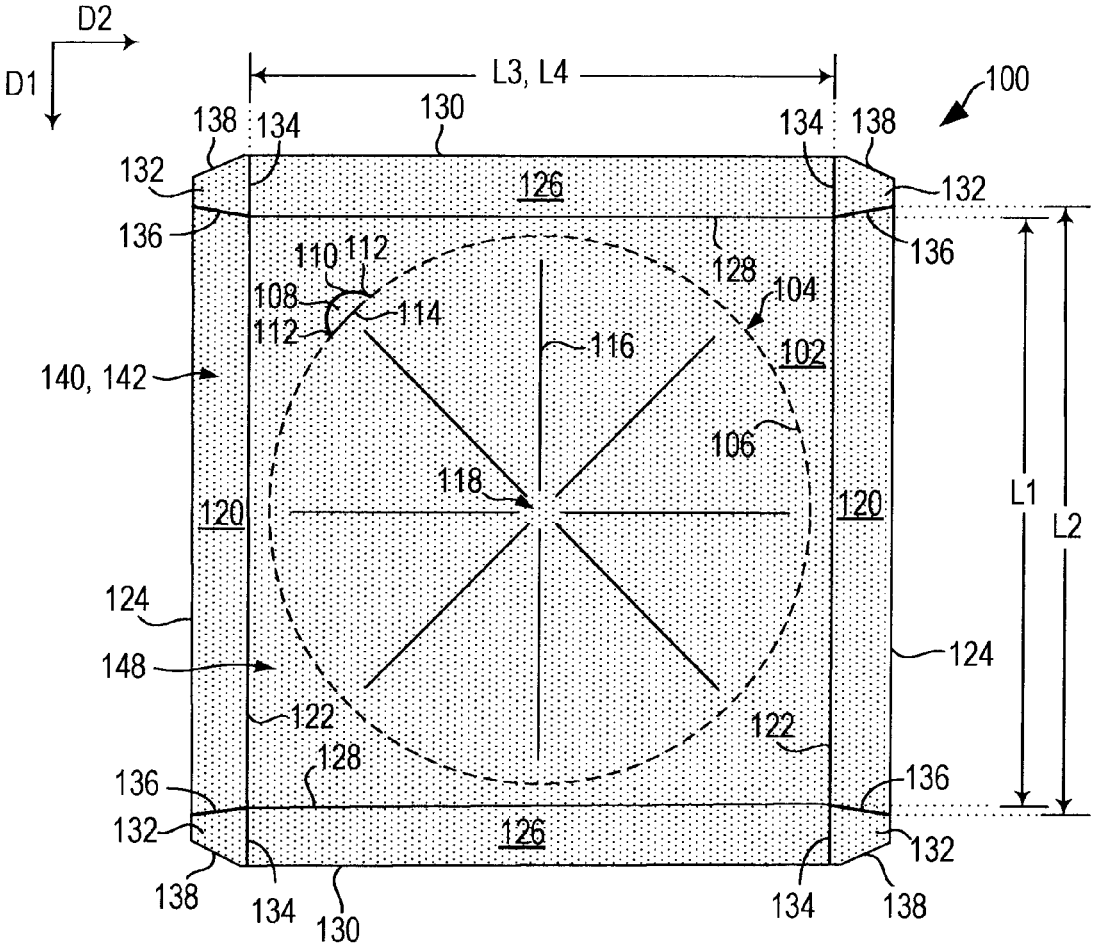
FIG. 1A is a schematic top plan view of an exemplary blank according to various aspects of the invention, having a square base panel.

FIG. 1A depicts an exemplary blank 100 according to various aspects of the present invention. The blank 100 includes a plurality of adjoined panels. In this and other examples of the invention discussed herein and/or contemplated hereby, each of the various panels and the blank generally has a first dimension, for example, a length, extending in a first direction, for example, a longitudinal direction, D1, and a second dimension, for example, a width, extending in a second direction, for example, a transverse direction, D2. It will be understood that such designations are made only for convenience and do not necessarily refer to or limit the manner in which the blank is manufactured or erected into a construct.

Still viewing FIG. 1A, the blank 100 includes a main panel or major panel or base panel 102 comprising a removable portion 104 defined at least partially by a line of disruption, for example, tear line 106. In this example, the base panel 102 is substantially square in shape and the removable panel or portion 104 is substantially circular in shape. However, in this and other examples, the base panel and removable panel may independently have any other desired shape, for example, circular, oval, triangular, square, rectangular, pentagonal, hexagonal, heptagonal, octagonal, or any other regular or irregular shape. The shape of the various panels and the resulting construct may be determined by the shape of the food product, and it will be understood that different shapes are contemplated for different food products, for example, sandwiches, pizzas, pastries, doughs, and so forth.

The removable portion 104 includes a tab 108 defined by a line of disruption, for example, cut line 110, which initiates and terminates at endpoints 112 proximate to tear line 106. In this example, cut line 110 is substantially arcuate in shape, such that tab 108 is substantially semi-circular in shape. However, it will be understood that, in this and other examples, the tab may have any shape as needed or desired. For example, the tab may be oval, rectangular, square, diamond-shaped, trapezoidal, polygonal, or any other regular or irregular shape. If desired, tear line 106 may be interrupted by a score line 114 that extends substantially between endpoints 112.

Optionally, the removable portion 104 includes a plurality of score lines or indentations 116 extending radially from a central area 118 of the panel 104. In this example, the blank 100 includes eight indentations. However, any number of such indentations may be used in accordance with the present invention. Thus, for example, the blank may include one, two, three, four, five, six, seven, eight, nine, ten, or any number of indentations as needed or desired for a particular application. Such indentations may serve as venting channels for moisture, as will be discussed further below. Alternatively, the indentations 116 may be formed in the opposite side of the panel 104 to form upwardly extending elongate protrusions.

Still viewing FIG. 1A, the blank 100 also includes a plurality of minor panels or side panels extending from the base panel 104. In particular, the blank 100 includes a first pair of opposed side panels 120 joined to the base panel 104 along respective fold lines 122, each of which corresponds generally to an edge of the substantially square base panel 104. Side panels 120 are somewhat trapezoidal in shape, with fold lines 122 having a length L1 less than the length L2 of panels 120 along edges 124.

The blank 100 also includes a second pair of opposed side panels 126 joined to the base panel 104 along respective fold lines 128, each of which also corresponds generally to an edge of the substantially square base panel 104. Side panels 126 are substantially rectangular in shape, with fold lines 128 having a length L3 approximately equal to the length L4 of panels 126 along edges 130. A pair of opposed end panels 132 is joined to each side panel 126 along respective fold lines 134. End panels 132 are separated from side panels 120 by respective cut lines or slits 136. If desired, end panels 132 may have tapered or "clipped" corners 138 to facilitate folding of the blank 100 into a container 144 (FIG. 1B).

If desired, a microwave energy interactive element 140 may overlie at least a portion of the blank 100, as shown schematically by stippling in FIG. 1A. The microwave energy interactive element may define at least a portion of a first surface 142 of the blank 100, and at least a portion of a first or interior surface 142 of a construct 144 formed from the blank 100, as shown schematically by stippling in FIGS. 1B and 1C. In one example, the microwave energy interactive element comprises a susceptor. However, other microwave energy interactive elements, such as those described below, are contemplated for use with the invention.

Figure 1B:
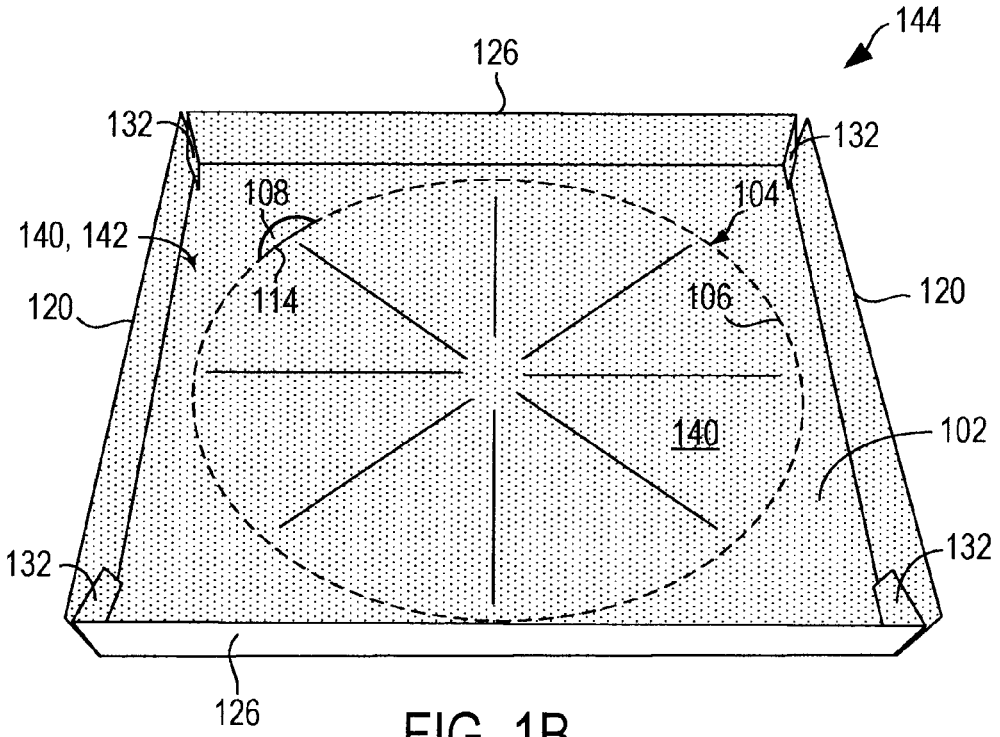
FIG. 1B is a schematic perspective view of an exemplary tray formed from the blank of FIG. 1A, according to various aspects of the invention.

Turning now to FIG. 1B, numerous sequences of steps may be used to form a tray, package, container, or other construct 144 according to the invention. In one example, end panels 132 may be folded toward side panels 126 along fold lines 134. Likewise, side panels 120, 126 may be folded toward the base panel 102 along respective fold lines 122, 128 to form somewhat upstanding members or walls, as shown in FIG. 1B. However, other sequences of folding are contemplated hereby. If desired, end panels 132 may be joined to side panels 120 using an adhesive, a weld, or any other suitable technique.

Figure 1C:
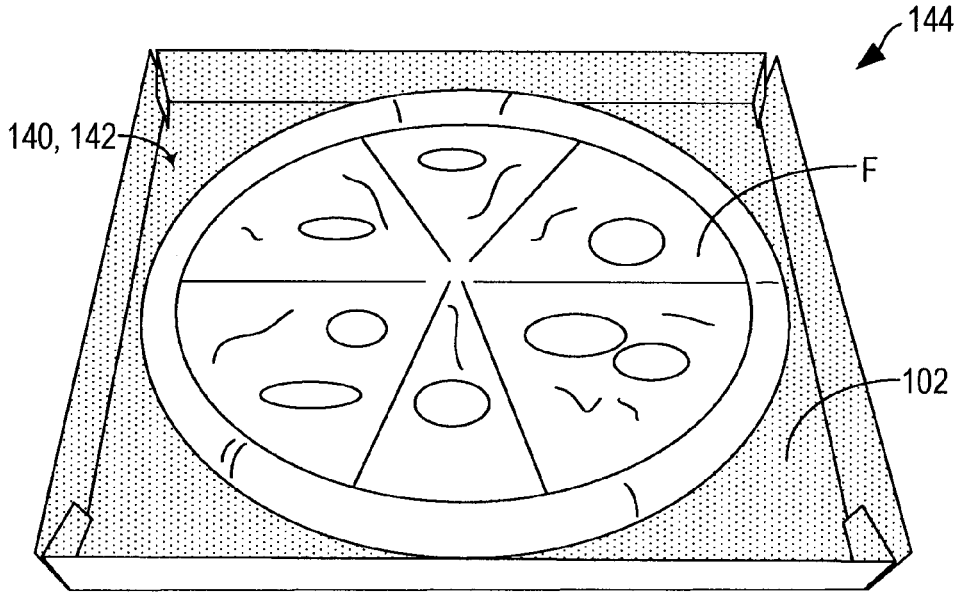
FIG. 1C is a schematic perspective view of the tray of FIG. 1B containing a food item.
Figure 1D:
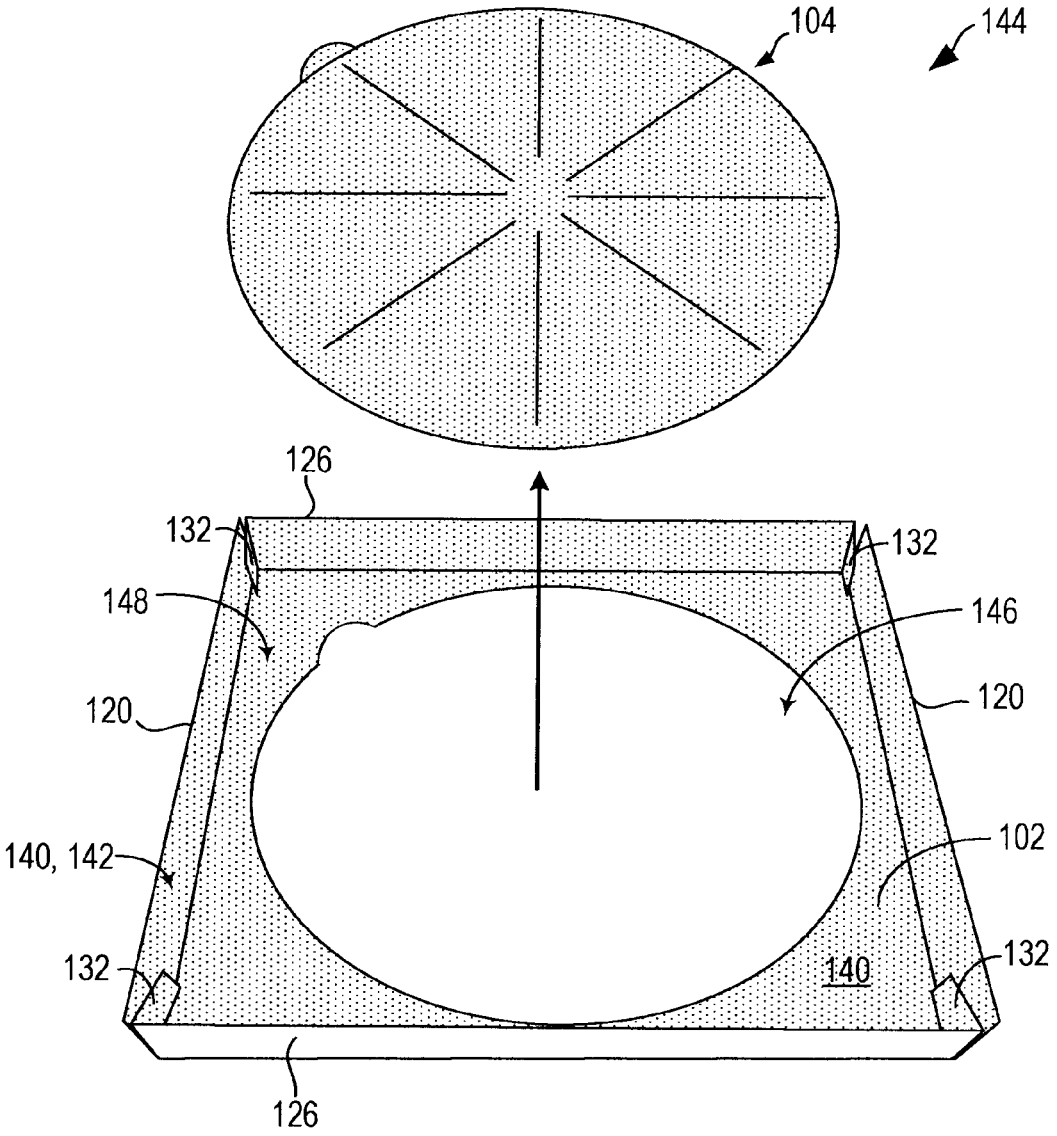
FIG. 1D is a schematic exploded view of the tray of FIG. 1B being separated into a heating, browning, and/or crisping disk and a heating, browning, and/or crisping ring, according to various aspects of the invention.

In this configuration, the construct 144 comprises a tray that may be used to contain a food item F, for example, a pizza, fruit or meat pie or other pastry, or a sandwich, as shown in FIG. 1C. If desired, the tray 144 with the food item therein may be placed into an outer carton or bag (not shown), or may be sealed with an overwrap (not shown). However, it will be understood that in some examples, the food item may be provided separately from the tray, and/or the tray may be provided in a collapsed or flattened configuration. To use the construct 144 according to one exemplary method, any food item F seated within the tray 144 may be removed. The user then may use a finger or other implement to apply pressure to tab 108, thereby causing it to fold or deflect away from the plane of the base panel 102 along score line 114 (FIG. 1B). Next, grasping tab 108, the removable panel 104 may be separated from the remainder of the construct 144 along tear line 106, as shown in FIG. 1D, thereby forming a void or opening 146 in the base panel 102. The remainder of the base panel 102 comprises a peripheral area 148 that circumscribes the opening 146.

Figure 1E:
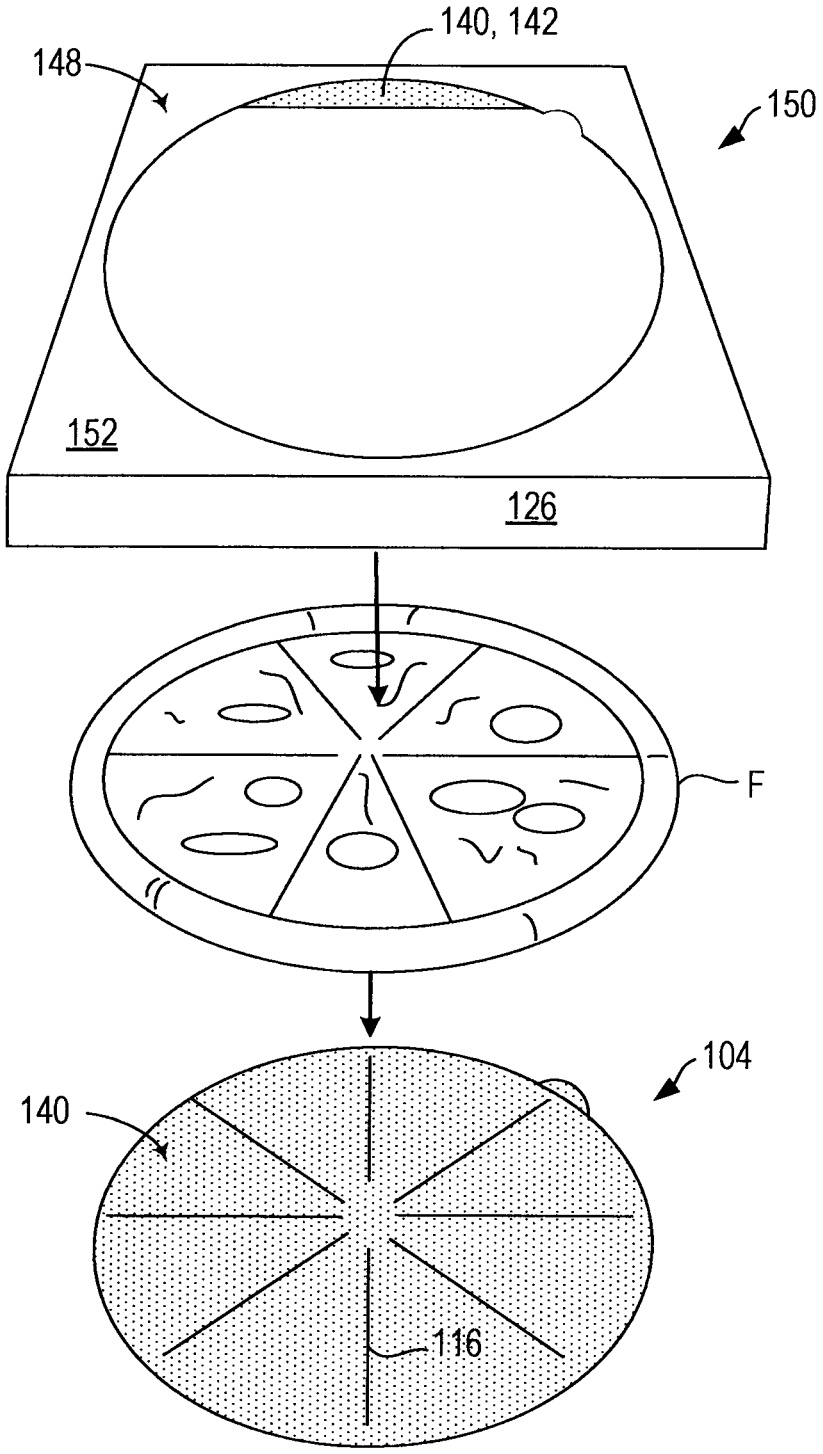
FIG. 1E is a schematic exploded view of the heating, browning, and/or crisping disk and ring of FIG. 1D in use with a food item.

According to another aspect of the invention illustrated schematically in FIG. 1E, the removable panel 104 may be used as a heating, browning, and/or crisping card or disk 104. To do so, a food item F may be seated on the disk 104 at least partially overlying the microwave energy interactive element 140, for example, the susceptor. When the food item F is heated in a microwave oven, the susceptor 140 converts microwave energy to thermal energy, which then can be transferred to the bottom of the food item F in proximate or intimate contact with the susceptor 140. As a result, the heating, browning, and/or crisping of the bottom surface of the food item F may be enhanced. Further more, indentations 116 may serve as venting channels that direct moisture away from the center of the food item, thereby further enhancing heating, browning, and/or crisping.

If desired, the remainder of the construct 144 may be used as a heating, browning, and/or crisping cover or somewhat square shaped "ring" 150 to heat, brown, and/or crisp at least a portion of the upper surface of the food item F and, optionally, at least a portion of the sides of the food item F. To do so, the ring 150 may be inverted, thereby exposing a second or outside surface of the ring 150 opposite the first or inside surface 142, and positioned over the food item F with the microwave energy interactive element 140, for example, the susceptor, in intimate or proximate contact with the surface of the food item F to be heated, browned, and/or crisped. For example, where the food item is a pizza, the opening 146 generally may overlie the pizza toppings and the peripheral area 148 of the base panel 102 generally may overlie the top portion of the pizza crust. When the food item F is heated in a microwave oven, the susceptor 140 converts microwave energy to thermal energy, which then can be transferred to the top and/or sides of the food item F to enhance heating, browning, and/or crisping of the food item F. Depending on the dimensions of the food item F and the ring 150, the ring 150 may be supported by side panels or walls 120, 126 (panels 120 shown in FIG. 1D), or may rest directly on the food item F with the food item F bearing the weight of the ring 150.

It will be understood that, in this and other embodiments of the invention, the dimensions of base panel 102 and removable panel or disk 104 (and therefore opening 146) may be selected to adjust which areas of the food item F are brought into proximate and/or intimate contact with the microwave energy interactive element 140. For example, where it is most desirable to brown and/or crisp the bottom surface of the food item F, the removable panel or disk 104 may be dimensioned to be about the same size as, or larger than, the bottom surface of the food item F. However, the resulting opening 146 formed in panel 102 may be so large that a portion of the top surface of the food item to be browned and/or crisped is exposed through the opening 146 and, therefore, not in intimate or proximate contact with the susceptor 140. Conversely, by reducing the size of the opening 146 to bring the top surface of the food item F into closer proximity to the susceptor 140, the size of the disk 104 is reduced. As a result, the food item F may extend beyond the dimensions of the disk 104 and may become less brown and/or crisp along the peripheral edges of the bottom surface. Further, the base panel 102 may be dimensioned to bring the side panels or support elements 120, 126 into closer proximity with the sides of the food item F, which may further enhance heating, browning, and/or crisping of the areas proximate to the susceptor 140.

Figure 2A:
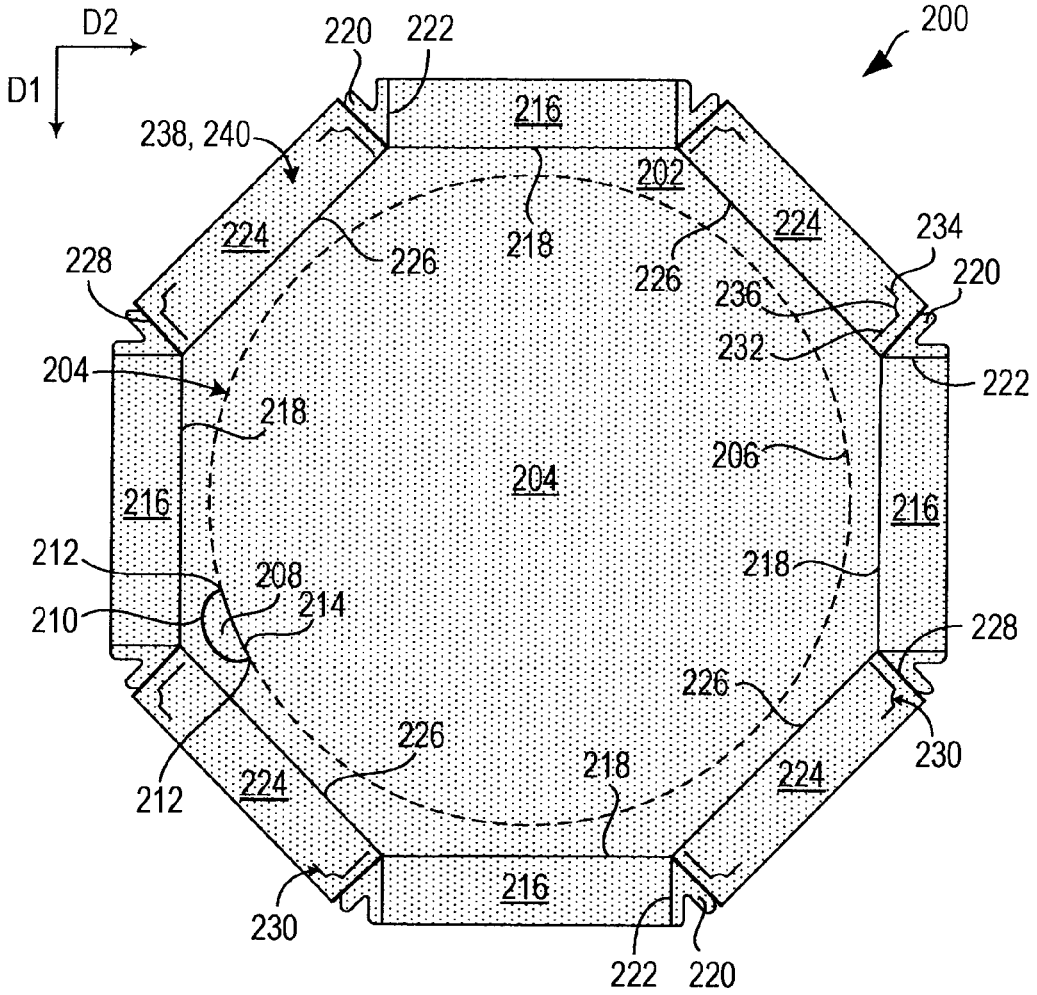
FIG. 2A is a schematic top plan view of another exemplary blank that may be used to form a construct according to various aspects of the invention, having a substantially octagonal base panel.

FIG. 2A depicts another exemplary blank 200 that may be used in accordance with the invention. The blank 200 includes a main panel or major panel or base panel 202 comprising a removable portion 204 defined at least partially by a tear line 206. In this example, the base panel 202 is substantially octagonal in shape and the removable panel or portion 204 is substantially circular in shape. However, other shapes are contemplated hereby.

The removable portion 204 optionally includes a tab 208 defined by a line of disruption, for example, cut line 210, which initiates and terminates at endpoints 212 proximate to tear line 206. In this example, cut line 210 is substantially arcuate in shape, such that tab 208 is substantially semicircular in shape. However, other tab shapes are contemplated. If desired, tear line 206 may be interrupted by a score line 214 that extends substantially between endpoints 212.

Still viewing FIG. 2, the blank 200 also includes a plurality of minor panels or side panels extending from the base panel 204. More particularly, two pairs of opposed side panels 216 are joined to the base panel along fold lines 218, each of which corresponds generally to an edge of the substantially octagonal base panel 204. The side panels 216 are substantially rectangular in shape, although other shapes are contemplated hereby. Locking tabs 220 are joined to each end of the various side panels 216 along fold lines 222 (only some of the locking tabs 220 and fold lines 222 are labeled in FIG. 2A). In this example, the locking tabs 220 are somewhat "V" shaped. However, other locking features or connection mechanisms are contemplated for use with the invention.

The blank 200 also includes two pairs of opposed side panels 224 joined to the base panel 204 along fold lines 226, each of which also corresponds generally to an edge of the substantially octagonal base panel 204. Each of the four side panels 224 is arranged in an alternating relation with each of the four side panels 216. Side panels 224 are separated from locking tabs 220 by cut lines 228 (only some of which are labeled in FIG. 2A).

Each side panel 222 includes a pair of opposed receiving slits 230, each being dimensioned to receive an adjacent locking tab or other locking feature 220. In this example, each receiving slit 230 includes a first, substantially linear segment 232 that is substantially perpendicular to the respective adjacent fold line 226, a second, substantially linear segment 234 that is substantially parallel to the respective adjacent fold line 226, and a third, inwardly arcuate segment 236 that extends between and substantially joins the first segment 232 and the second segment 234 (only one of each of the first, second, and third segments 232, 234, 236 are labeled in FIG. 2A). However, other receiving features are contemplated by the invention.

If desired, a microwave energy interactive element 238 may overlie at least a portion of the blank 200, as shown schematically by stippling in FIG. 2A. The microwave energy interactive element 238 may define at least a portion of a first surface 240 of the blank 200, and may define at least a portion of a first or inside surface 240 of a construct 242 (FIGS. 2B and 2C) formed from the blank 200. In one example, the microwave energy interactive element comprises a susceptor. However, other microwave energy interactive elements, such as those described below, are contemplated for use with the invention.

To form a tray or construct 242 from the blank 200 according to one acceptable method, side panels 216, 224 may be folded toward the first surface 240 of the blank 200 to form generally upstanding members or walls. If desired, the various locking tabs 220 may be inserted into the respective adjacent receiving slits 230 to secure the construct 242 in this configuration, as shown schematically in an inverted position in FIG. 2B. The construct 242 may be used as a tray or package to contain a food item, as discussed above in connection with FIGS. 1B and 1C.

Figure 2C:
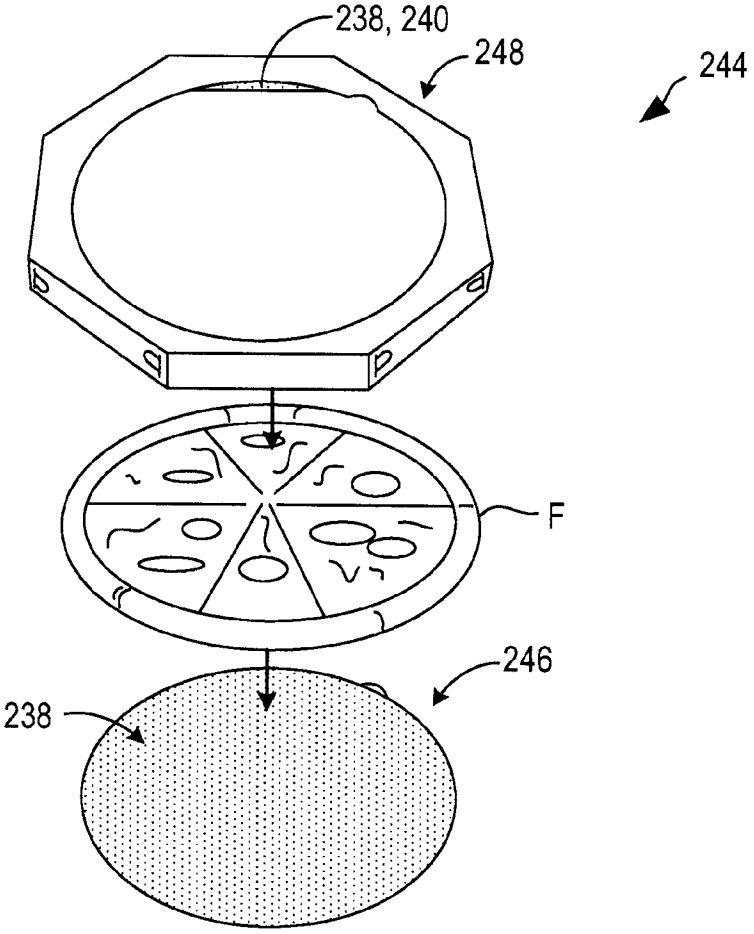
FIG. 2C is a schematic exploded view of the tray of FIG. 2B separated into a heating, browning, and/or crisping disk and a heating, browning, and/or crisping ring, according to various aspects of the invention, in use with a food item.
Figure 2B:
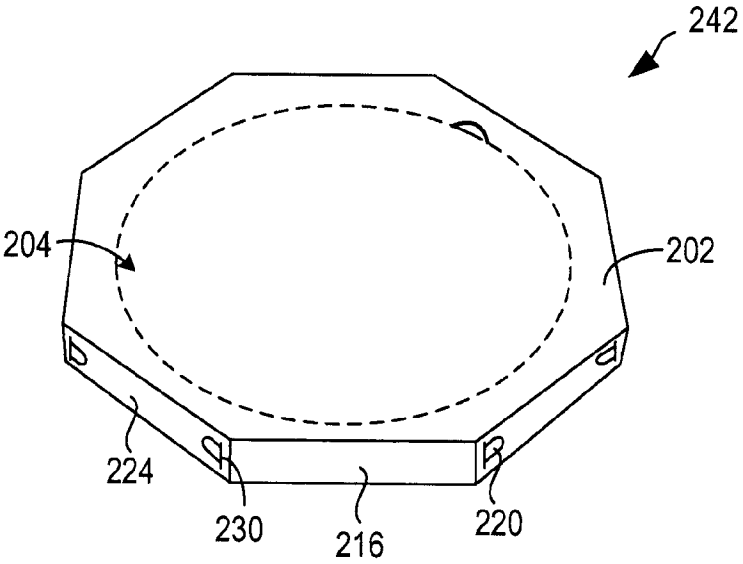
FIG. 2B is a schematic perspective view of an exemplary tray formed from the blank of FIG. 2A, according to various aspects of the invention, in an inverted configuration.

If desired, the removable panel 204 may be separated from the remainder of the construct 242 to form a heating, browning, and/or crisping system 244 including a disk 246 and cover or ring 248, as shown schematically in FIG. 2C, and may be used to heat, brown, and/or crisp a food item F in the manner generally described in connection with FIGS. 1C-1E. It is noted that, in this example, the ring 248 has an overall octagonal shape that may be more suitable for some microwave ovens that include a turntable and that cannot accommodate the rotation of a square shaped ring. Furthermore, where a susceptor 238 is used, the octagonal shape of ring 248 provides greater conformance to the sides of the food item F and, therefore, may enhance browning and crisping of the sides of the food item F.

Figure 3:
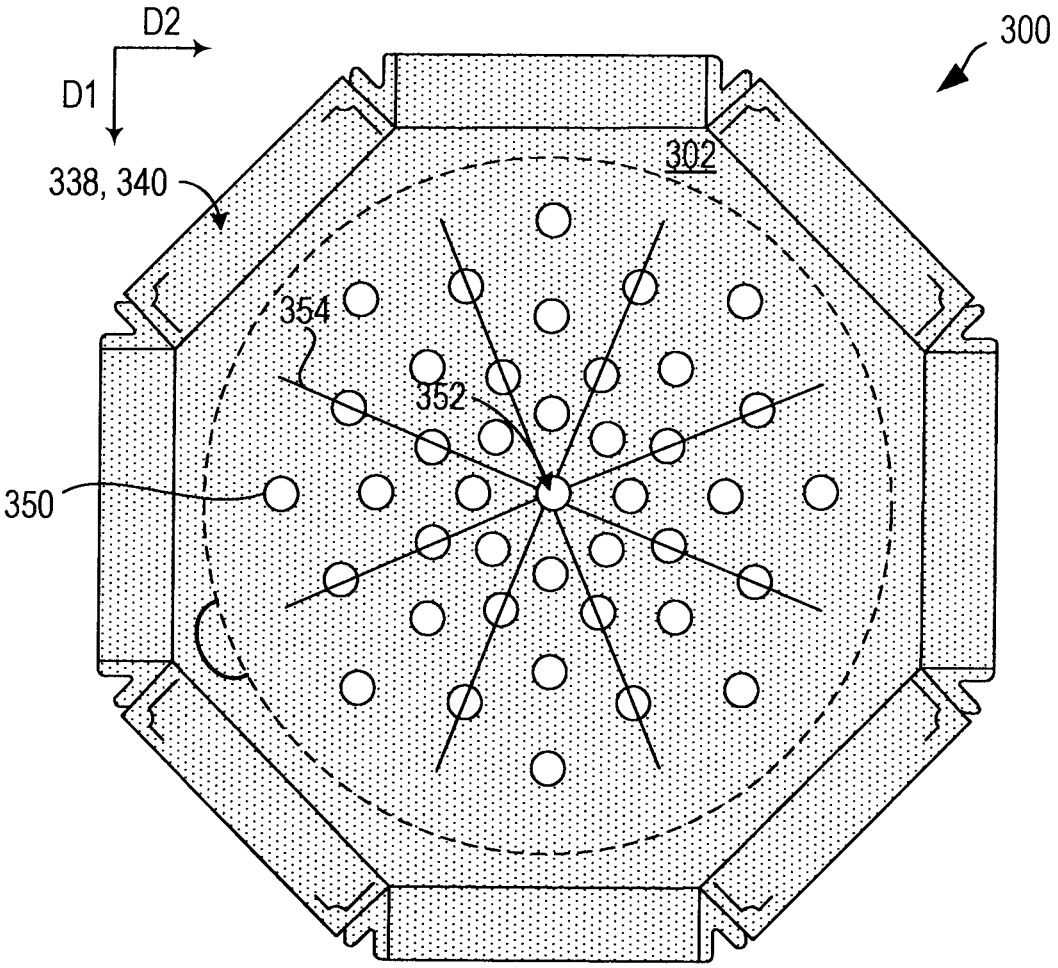
FIG. 3 is a schematic top plan view of a variation of the blank of FIG. 2A, including a plurality of microwave energy transparent areas and a plurality of venting channels.

FIG. 3 illustrates another blank 300 that may be used in accordance with the invention. The blank 300 includes features that are similar to blank 200 shown in FIG. 2A, except for variations noted and variations that will be understood by those of skill in the art. For simplicity, and not limitation, the reference numerals of similar features are preceded in the figures with a "3" instead of a "2". The blank 300 may be used to form trays, containers, heating systems, and other constructs according to the invention and may be used to contain, heat, brown, and/or crisp a food item, as described in connection with FIGS. 1B-1H, with variations noted and variations that will be understood by those of skill in the art.

In this example, the blank 300 includes a plurality of microwave energy inactive or transparent areas or "apertures" 350 circumscribed by the microwave energy interactive element 338. The microwave energy inactive or transparent areas are somewhat circular in shape and more concentrated near a central area 352 of the base panel 302. However, other shapes, numbers, and configurations of microwave energy transparent areas are contemplated. The number, shape, size, and positioning of such apertures may vary for a particular application depending on type of construct being formed from the blank, the food item to be heated therein or thereon, the desired degree of browning and/or crisping, whether direct exposure to microwave energy is needed or desired to attain uniform heating of the food item, the need for regulating the change in temperature of the food item through direct heating, and whether and to what extent there is a need for venting. The microwave energy transparent areas may be formed in any suitable manner, as will be discussed further below.

The blank 300 also includes a plurality of score lines or indentations 354 extending radially from the central area 352 of the base panel 304. In this example, the blank 300 includes eight indentations. However, any number of such indentations may be used in accordance with the present invention. Such indentations may serve as venting channels, as discussed above in connection with FIGS. 1A and 1E.

Figure 4:
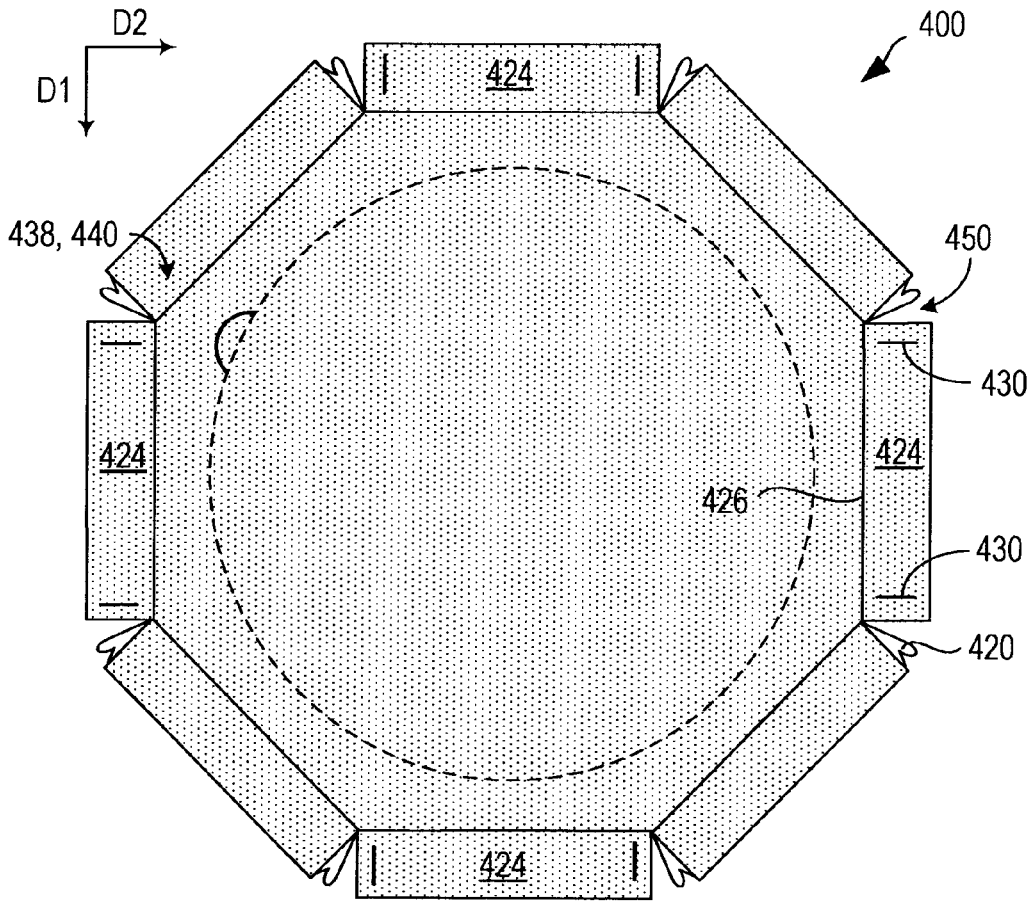
FIG. 4 is a schematic top plan view of another variation of the blank of FIG. 2A, including alternate locking tabs and receiving slits.

FIG. 4 illustrates another blank 400 that may be used in accordance with the invention. The blank 400 includes features that are similar to blank 200 shown in FIG. 2A, except for variations noted and variations that will be understood by those of skill in the art. For simplicity, and not limitation, the reference numerals of similar features are preceded in the figures with a "4" instead of a "2". The blank 400 may be used to form trays, containers, heating systems, and other constructs according to the invention and may be used to contain, heat, brown, and/or crisp a food item, as described in connection with FIGS. 1B-1H, with variations noted and variations that will be understood by those of skill in the art.

In this example, each side panel 424 includes a pair of substantially parallel receiving slits 430, each dimensioned to receive an adjacent locking tab 420. Each slit 430 is substantially perpendicular to the respective adjacent fold line 426. However, other configurations are contemplated by the invention. Further, each locking tab 420 is separated from the adjacent panel 424 by a cutout 450. The precise shape and dimension of cutout 450 may vary for a particular application.

Numerous other blanks and constructs are contemplated by the invention. Likewise, numerous materials may be suitable for use in forming the various blanks and constructs of the invention, provided that the materials are resistant to softening, scorching, combusting, or degrading at typical microwave oven heating temperatures, for example, at from about 250° F. to about 425° F. The particular materials used may include microwave energy interactive materials and microwave energy transparent or inactive materials.

For example, any of the various constructs of the present invention may include one or more features that alter the effect of microwave energy during the heating or cooking of the food item. For instance, as stated above, the construct include one or more microwave energy interactive elements (hereinafter sometimes referred to as "microwave interactive elements") that promote browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular microwave heating construct and food item.

The microwave interactive element may be supported on a microwave inactive or transparent substrate for ease of handling and/or to prevent contact between the microwave interactive material and the food item. As a matter of convenience and not limitation, and although it is understood that a microwave interactive element supported on a microwave transparent substrate includes both microwave interactive and microwave inactive elements or components, such constructs are referred to herein as "microwave interactive webs".

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymeric film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In one example, the microwave interactive element may comprise a thin layer of microwave interactive material that tends to absorb microwave energy, thereby generating heat at the interface with a food item. Such elements often are used to promote browning and/or crisping of the surface of a food item (sometimes referred to as a "browning and/or crisping element"). When supported on a film or other substrate, such an element may be referred to as a "susceptor film" or, simply, "susceptor". In the example illustrated in FIG. 1A, the blank 100 includes a susceptor film 140 substantially overlying and at least partially defining a first surface 142 (e.g. substantially one side) of the blank 100. However, other microwave energy interactive elements, such as those described herein, are contemplated hereby.

For example, the microwave interactive element may comprise a foil having a thickness sufficient to shield one or more selected portions of the food item from microwave energy (sometimes referred to as a "shielding element"). Such shielding elements may be used where the food item is prone to scorching or drying out during heating.

The shielding element may be formed from various materials and may have various configurations, depending on the particular application for which the shielding element is used. Typically, the shielding element is formed from a conductive, reflective metal or metal alloy, for example, aluminum, copper, or stainless steel. The shielding element generally may have a thickness of from about 0.000285 inches to about 0.05 inches. In one aspect, the shielding element has a thickness of from about 0.0003 inches to about 0.03 inches. In another aspect, the shielding element has a thickness of from about 0.00035 inches to about 0.020 inches, for example, 0.016 inches.

As still another example, the microwave interactive element may comprise a segmented foil, such as, but not limited to, those described in U.S. Pat. Nos. 6,204,492, 6,433,322, 6,552,315, and 6,677,563, each of which is incorporated by reference in its entirety. Although segmented foils are not continuous, appropriately spaced groupings of such segments often act as a transmitting element to direct microwave energy to specific areas of the food item. Such foils also may be used in combination with browning and/or crisping elements, for example, susceptors. As another example, the microwave interactive element may comprise a foil having a thickness sufficient to shield one or more selected portions of the food item from microwave energy (sometimes referred to as a "shielding element"). Such shielding elements may be used where the food item is prone to scorching or drying out during heating.

The shielding element may be formed from various materials and may have various configurations, depending on the particular application for which the shielding element is used. Typically, the shielding element is formed from a conductive, reflective metal or metal alloy, for example, aluminum, copper, or stainless steel. The shielding element generally may have a thickness of from about 0.000285 inches to about 0.05 inches. In one aspect, the shielding element has a thickness of from about 0.0003 inches to about 0.03 inches. In another aspect, the shielding element has a thickness of from about 0.00035 inches to about 0.020 inches, for example, 0.016 inches.

As still another example, the microwave interactive element may comprise a segmented foil, such as, but not limited to, those described in U.S. Pat. Nos. 6,204,492, 6,433,322, 6,552,315, and 6,677,563, each of which is incorporated by reference in its entirety. Although segmented foils are not continuous, appropriately spaced groupings of such segments often act as a transmitting element to direct microwave energy to specific areas of the food item. Such foils also may be used in combination with browning and/or crisping elements, for example, susceptors.

Any of the numerous microwave interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and positioned to heat particular areas of the food item selectively. The number, shape, size, and positioning of such breaks or apertures may vary for a particular application depending on type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, and whether and to what extent there is a need for venting.

It will be understood that the aperture may be a physical aperture or void in the material used to form the construct, or may be a non-physical "aperture". A non-physical aperture may be a portion of the construct that is microwave energy inactive by deactivation or otherwise, or one that is otherwise transparent to microwave energy (e.g. apertures 350 in FIG. 3). Thus, for example, the aperture may be a portion of the construct formed without a microwave energy active material or, alternatively, may be a portion of the construct formed with a microwave energy active material that has been deactivated. While both physical and non-physical apertures allow the food item to be heated directly by the microwave energy, a physical aperture also provides a venting function to allow steam or other vapors to be released from the food item.

As stated above, any of the above elements and numerous others contemplated hereby may be supported on a substrate. The substrate typically comprises an electrical insulator, for example, a polymeric film or material. As used herein the term "polymer" or "polymeric material" includes, but is not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymeric films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymeric film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.).

The polymeric film may be selected to impart various properties to the microwave interactive web, for example, printability, heat resistance, or any other property. As one particular example, the polymeric film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one aspect, the barrier film has an OTR of less than about 10 $cc/m^2/day$. In another aspect, the barrier film has an OTR of less than about 1 $cc/m^2/day$. In still another aspect, the barrier film has an OTR of less than about 0.5 $cc/m^2/day$. In yet another aspect, the barrier film has an OTR of less than about 0.1 $cc/m^2/day$.

The barrier film may have a water vapor transmission rate (WVTR) of less than about 100 $g/m^2/day$ as measured using ASTM F1249. In one aspect, the barrier film has a WVTR of less than about 50 $g/m^2/day$. In another aspect, the barrier film has a WVTR of less than about 15 $g/m^2/day$. In yet another aspect, the barrier film has a WVTR of less than about 1 $g/m^2/day$. In still another aspect, the barrier film has a WVTR of less than about 0.1 $g/m^2/day$. In a still further aspect, the barrier film has a WVTR of less than about 0.05 $g/m^2/day$.

Other non-conducting substrate materials such as metal oxides, silicates, cellulosics, or any combination thereof, also may be used in accordance with the present invention.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item.

For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5,221,419; 5,213,902; 5,117,078; 5,039,364; 4,963,424; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

The microwave interactive element or microwave interactive web may be joined to or overlie a dimensionally stable, microwave energy transparent support (hereinafter referred to as "microwave transparent support", "microwave inactive support" or "support") to form the construct.

In one aspect, for example, where a rigid or semi-rigid construct is to be formed, all or a portion of the support may be formed at least partially from a paperboard material, which may be cut into a blank prior to use in the construct. For example, the support may be formed from paperboard having a basis weight of from about 60 to about 330 lbs/ream, for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

In another aspect, where a more flexible construct is to be formed, the support may comprise a paper or paper-based material generally having a basis weight of from about 15 to about 60 lbs/ream, for example, from about 20 to about 40 lbs/ream. In one particular example, the paper has a basis weight of about 25 lbs/ream.

Optionally, one or more portions of the various blanks or other constructs described herein or contemplated hereby may be coated with varnish, clay, or other materials, either alone or in combination. The coating may then be printed over with product advertising or other information or images. The blanks or other constructs also may be coated to protect any information printed thereon.

Furthermore, the blanks or other constructs may be coated with, for example, a moisture and/or oxygen barrier layer, on either or both sides, such as those described above. Any suitable moisture and/or oxygen barrier material may be used in accordance with the present invention. Examples of materials that may be suitable include, but are not limited to, polyvinylidene chloride, ethylene vinyl alcohol, DuPont DARTEK™ nylon 6,6, and others referred to above.

Alternatively or additionally, any of the blanks or other constructs of the present invention may be coated or laminated with other materials to impart other properties, such as absorbency, repellency, opacity, color, printability, stiffness, or cushioning. For example, absorbent susceptors are described in U.S. Provisional Application No. 60/604,637, filed Aug. 25, 2004, and U.S. Patent Application Publication No. 2006/0049190 A1, both of which are incorporated herein by reference in their entirety. Additionally, the blanks or other constructs may include graphics or indicia printed thereon.

It will be understood that with some combinations of elements and materials, the microwave interactive element may have a grey or silver color this is visually distinguishable from the substrate or the support. However, in some instances, it may be desirable to provide a web or construct having a uniform color and/or appearance. Such a web or construct may be more aesthetically pleasing to a consumer, particularly when the consumer is accustomed to packages or containers having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the web with a silver or grey ink or other concealing color in a suitable pattern or as a solid color layer to mask or conceal the presence of the microwave interactive element, or any other suitable technique or combination thereof.

If desired, a combination of paper layers, polymer film layers, and microwave interactive elements may be used to form a microwave energy interactive insulating material or structure. As used herein, the terms "microwave energy interactive insulating material", "microwave energy interactive insulating structure", "microwave interactive insulating material", "microwave interactive structure", "insulating material", or "insulating structure" refer any arrangement or combination of layers of materials that is both responsive to microwave energy and capable of providing some degree of thermal insulation when used to heat a food item.

An insulating material may be used to form all or a portion of a blank or construct according to the present invention. For example, all or a portion of the microwave energy interactive elements 140, 238, 338, 438 shown schematically by stippling in FIGS. 1A-4 may comprise a microwave energy interactive insulating material. Although FIGS. 1A-4 schematically illustrate a microwave energy interactive elements 140, 238, 338, 438 defining substantially all of the respective first surfaces 142, 240, 340, 440 of the various blanks 100, 200, 300, 400 and constructs 144, 242, 244, it will be understood that the microwave energy interactive insulating material may overlie only a portion of the blank or construct according to the invention.

Where an insulating material overlies the removable panel or portion of the construct, and therefore, the heating, browning, and/or crisping card or disk, it will be understood that the user may be instructed to place the food item on the side of the disk overlying the insulating material or on the opposite side, such that the insulating material rests on the floor of the microwave oven. The precise instructions provided to the user may depend on the desired degree of heating, browning, crisping, and thermal insulation for the particular food item, or may depend on numerous other factors.

In one aspect, the insulating material or structure comprises one or more susceptor layers in combination with one or more expandable insulating cells. Additionally, the insulating material may include one or more microwave energy transparent or inactive materials to provide dimensional stability, to improve ease of handling the microwave energy interactive material, and/or to prevent contact between the microwave energy interactive material and the food item. For example, an insulating material may comprise a microwave energy interactive material supported on a first polymeric film layer, a moisture-containing layer superposed with the microwave energy interactive material, and a second polymeric film layer joined to the moisture-containing layer in a predetermined pattern, thereby forming one or more closed cells between the moisture-containing layer and the second polymeric film layer. The closed cells expand or inflate in response to being exposed to microwave energy, thereby causing the microwave energy interactive structure to bulge and deform.

Several exemplary insulating materials are depicted in FIGS. 5A-8B. It will be understood that the layer widths are not necessarily shown in perspective. In some instances, for example, the adhesive layers may be very thin with respect to other layers, but are nonetheless shown with some thickness for purposes of clearly illustrating the arrangement of layers.

Figure 5A:
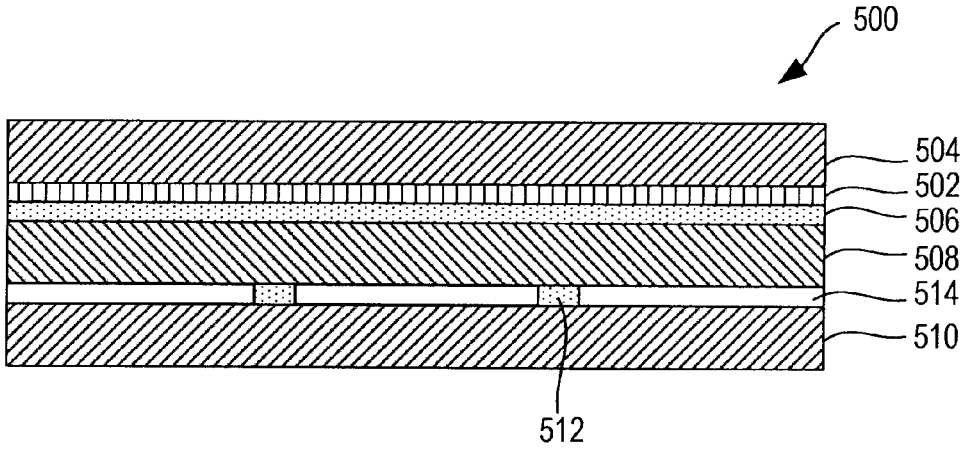
FIG. 5A is a schematic cross-sectional view of an exemplary microwave energy interactive insulating material that may be used in accordance with various aspects of the invention.
Figure 5B:
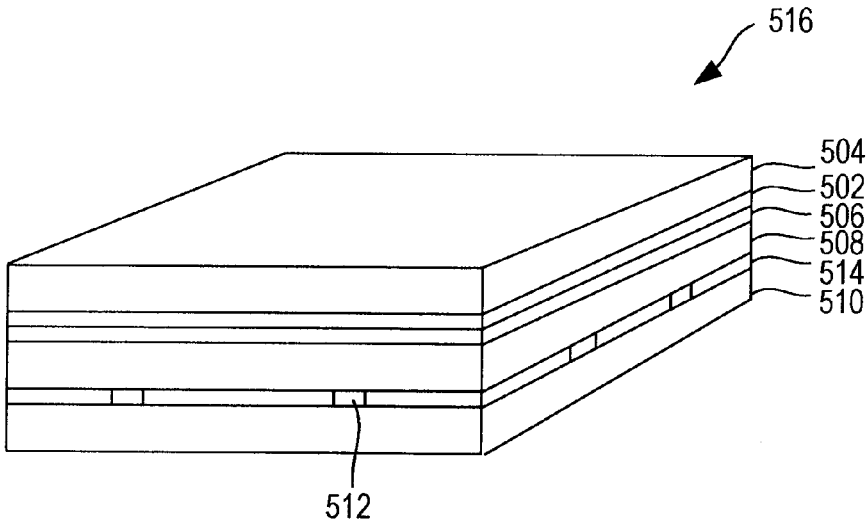
FIG. 5B is a schematic perspective view of the microwave energy interactive insulating material of FIG. 5A, in the form of a cut sheet.

FIG. 5A depicts an exemplary microwave energy interactive insulating material 500 that may be suitable for use with the various aspects of the invention. In this example, a thin layer of microwave energy interactive material that serves as a susceptor 502 is supported on a first polymer film 504 (collectively forming a "susceptor film") and bonded by lamination with an adhesive 506 (or otherwise) to a dimensionally stable substrate 508, for example, paper. The substrate 508 is bonded to a second polymer film 510 using a patterned adhesive 512 or other material, thereby forming a plurality of expandable insulating cells 514. The insulating material 500 may be cut and provided as a substantially flat, multi-layered sheet 516, as shown in FIG. 5B.

Figure 5C:
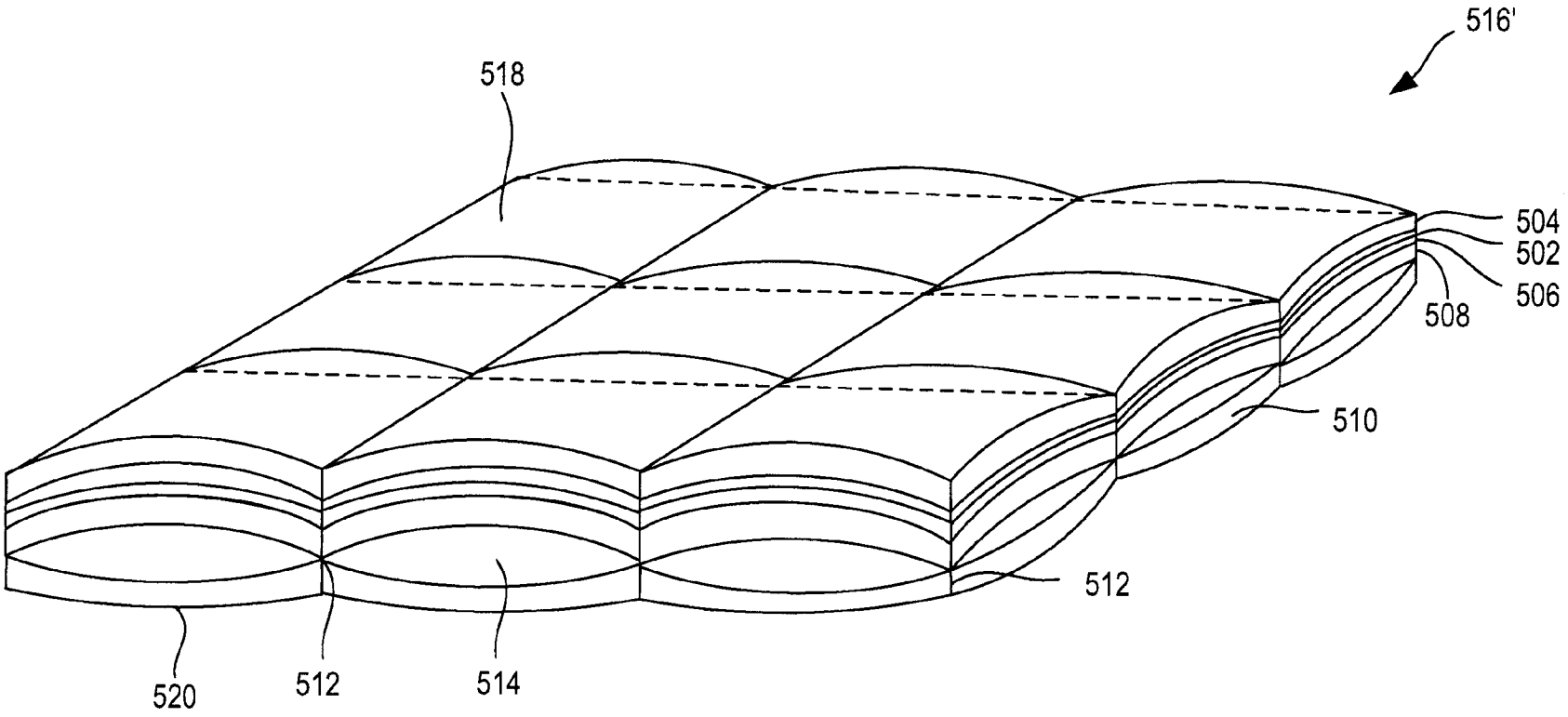
FIG. 5C is a schematic perspective view of the microwave energy interactive insulating material of FIG. 5B, after sufficient exposure to microwave energy.

As the susceptor 502 heats upon impingement by microwave energy, water vapor and other gases typically held in the substrate 508, for example, paper, and any air trapped within the closed cells 514 between the second polymer film 510 and the substrate 508, expand, as shown in FIG. 5C. The resulting insulating material 516' has a quilted or pillowed or lofted top surface 518 and bottom surface 520. When microwave heating has ceased, the cells 514 typically deflate and the insulating structure returns to a somewhat flattened state.

Figure 5D:
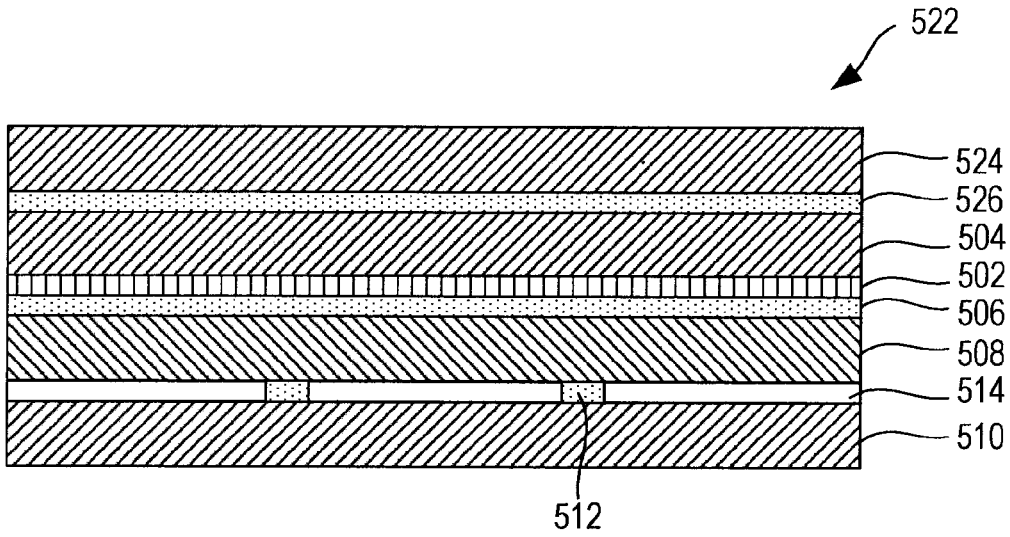
FIG. 5D is a schematic cross-sectional view of a variation of the exemplary microwave energy interactive insulating material of FIG. 5A.

If desired, the insulating material 500 may be modified to form a structure 522 that includes an additional paper or polymer film layer 524 joined to the first polymer film layer 504 using an adhesive 526 or other suitable material, as shown in FIG. 5D.

Figure 6:
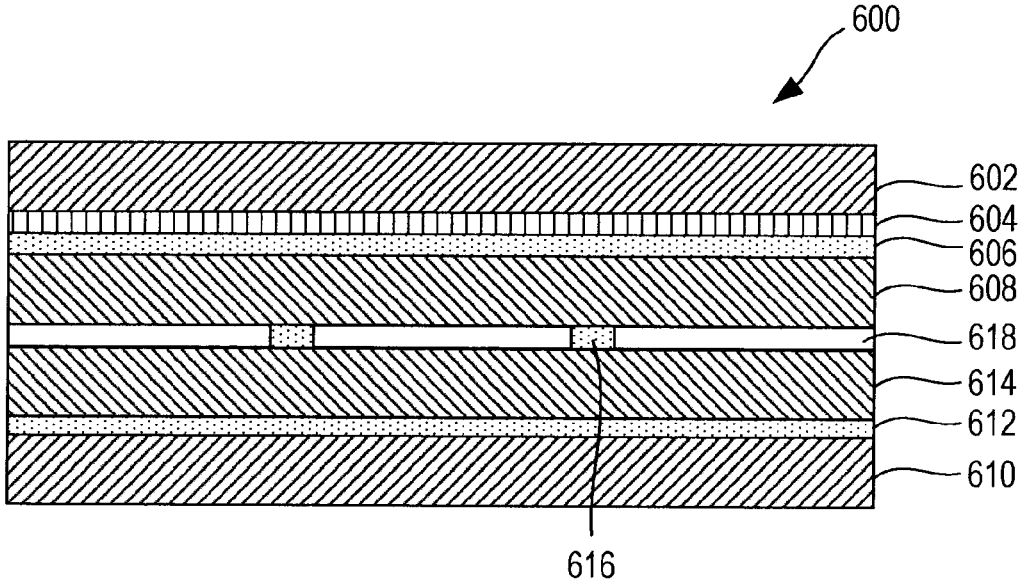
FIG. 6 is a schematic cross-sectional view of another microwave energy interactive insulating material that may be used in accordance with the invention.

FIG. 6 illustrates another exemplary insulating material 600. The material 600 includes a polymer film layer 602, a susceptor layer 604, an adhesive layer 606, and a paper layer 608.

Additionally, the material 600 may include a second polymer film layer 610, an adhesive 612, and a paper layer 614. The layers may be adhered or affixed by a patterned adhesive 616 that defines a plurality of closed expandable cells 618.

Figure 7:
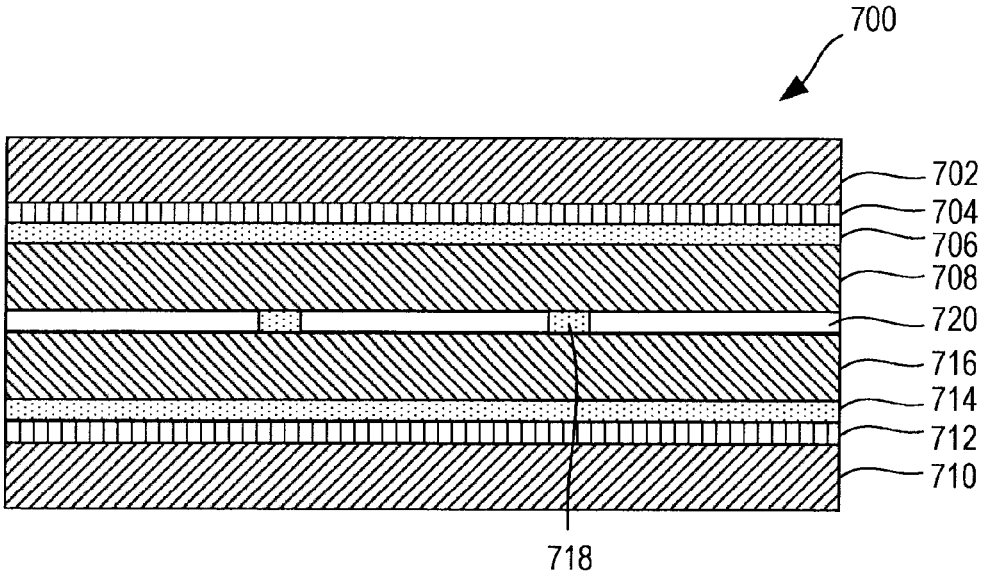
FIG. 7 is a schematic cross-sectional view of yet another microwave energy interactive insulating material that may be used in accordance with the invention.

FIG. 7 illustrates yet another exemplary insulating material 700 that may be suitable for use with the invention. In this example, the insulating material 700 includes a pair of adjoined, symmetrical layer arrangements. If desired, the two symmetrical arrangements may be formed by folding one layer arrangement onto itself.

The first symmetrical layer arrangement, beginning at the top of the drawing, comprises a polymer film layer 702, a susceptor layer 704, an adhesive layer 706, and a paper or paperboard layer 708. The adhesive layer 706 bonds the polymer film 702 and the susceptor layer 704 to the paperboard layer 708.

The second symmetrical layer arrangement, beginning at the bottom of the drawing, also comprises a polymer film layer 710, a susceptor layer 712, an adhesive layer 714, and a paper or paperboard layer 716. A patterned adhesive layer 718 is provided between the two paper layers 708, 716, and defines a pattern of closed cells 720 configured to expand when exposed to microwave energy.

By using an insulating material 700 having respective susceptors 704, 712 on each side of the expandable insulating cells 720, more heat is generated, thereby achieving greater loft of the cells 720. As a result, such a material is able to elevate a food item seated thereon to a greater extent than an insulating material having a single susceptor layer.

It will be recognized that each of the exemplary insulating materials depicted in FIGS. 5A-7 include a moisture-containing layer (e.g. paper) that is believed to release at least a portion of the vapor that inflates the expandable cells. However, it is contemplated that structures that are adapted to inflate without such moisture-containing layers also may be used in accordance with the invention.

Figure 8A:
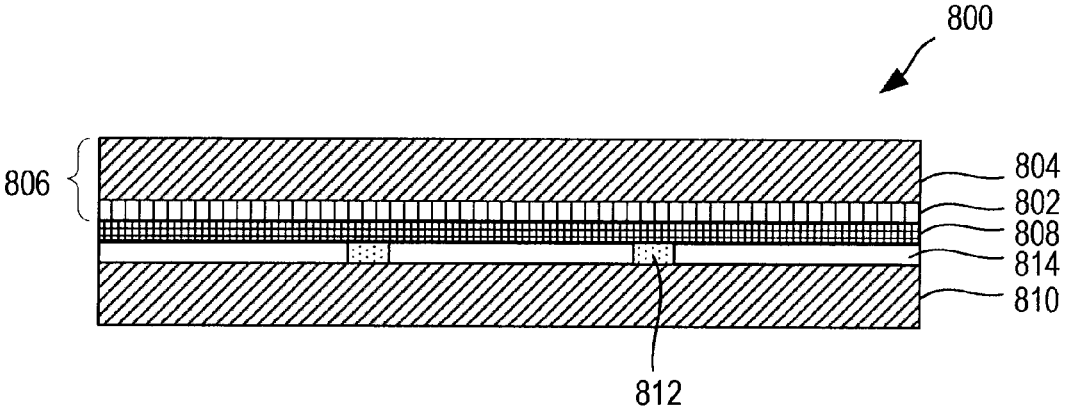
FIG. 8A is a schematic cross-sectional view of yet another exemplary microwave energy interactive insulating material that may be used in accordance with various aspects of the invention.

FIG. 8A illustrates one example of an expandable cell insulating material 800 that is adapted to inflate without the use of a moisture-containing layer, for example, paper. In this example, one or more reagents are used to generate a gas that expands the cells of the insulating material. For example, the reagents may comprise sodium bicarbonate ($NaHCO_3$) and a suitable acid. When exposed to heat, the reagents react to produce carbon dioxide. As another example, the reagent may comprise a blowing agent. Examples of blowing agents that may be suitable include, but are not limited to, p-p'-oxybis (benzenesulphonylhydrazide), azodicarbonamide, and p-toluenesulfonylsemicarbazide. However, it will be understood that numerous other reagents and released gases are contemplated hereby.

In the example shown in FIG. 8A, a thin layer of microwave interactive material 802 is supported on a first polymer film 804 to form a susceptor film 806. One or more reagents 808, optionally within a coating, lie adjacent at least a portion of the layer of microwave interactive material 802. The reagent 808 coated susceptor film 806 is joined to a second polymer film 810 using a patterned adhesive 812 or other material, or using thermal bonding, ultrasonic bonding, or any other suitable technique, such that closed cells 814 (shown as a void) are formed in the material 800.

Figure 8B:
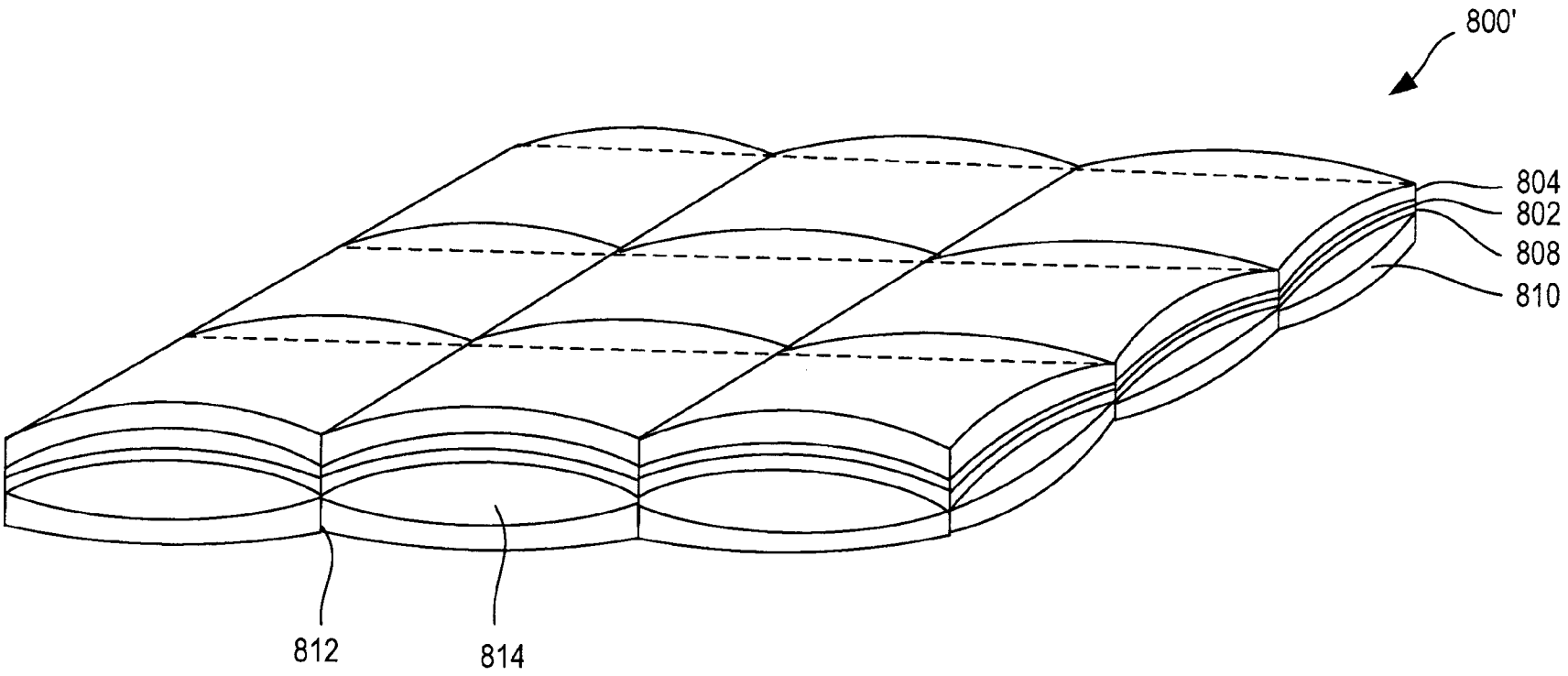
FIG. 8B is a schematic perspective view of the microwave energy interactive insulating material of FIG. 8A, after sufficient exposure to microwave energy.

As discussed in connection with the other exemplary insulating materials, as the microwave interactive material 802 heats upon impingement by microwave energy, water vapor or other gases are released from or generated by the reagent 808. The resulting gas applies pressure on the susceptor film 806 on one side and the second polymer film 810 on the other side of the closed cells 814. Each side of the material 800 reacts simultaneously, but uniquely, to the heating and vapor expansion to form a pillowed or quilted insulating material 800' (FIG. 8B). This expansion may occur within 1 to 15 seconds in an energized microwave oven, and in some instances, may occur within 2 to 10 seconds. Even without a paper or paperboard layer, the water vapor resulting from the reagent is sufficient both to inflate the expandable cells and to absorb any excess heat from the microwave energy interactive material. Such materials are described further in U.S. Patent Application Publication No. 2006/0289521 A1, which is incorporated by reference herein in its entirety.

It will be understood that any of the microwave energy interactive insulating materials described herein or contemplated hereby may include an adhesive pattern or thermal bond pattern that is selected to enhance cooking of a particular food item. For example, where the food item is a larger item, the adhesive pattern may be selected to form substantially uniformly shaped expandable cells. Where the food item is a small item, the adhesive pattern may be selected to form a plurality of different sized cells to allow the individual items to be variably contacted on their various surfaces. While several examples are provided herein, it will be understood that numerous other patterns are contemplated hereby, and the pattern selected will depend on the heating, browning, crisping, and insulating needs of the particular food item.

If desired, multiple layers of insulating materials and other microwave energy interactive elements may be used to enhance the insulating properties of the insulating material and, therefore, enhance the browning and crisping of the food item. Where multiple layers are used, the layers may remain separate or may be joined using any suitable process or technique, for example, thermal bonding, adhesive bonding, ultrasonic bonding or welding, mechanical fastening, or any combination thereof. In one example, two sheets of an insulating material may be arranged so that their respective susceptor film layers are facing away from each other. In another example, two sheets of an insulating material may be arranged so that their respective susceptor film layers are facing towards each other. In still another example, multiple sheets of an insulating material may be arranged in a like manner and superposed. In a still further example, multiple sheets of various insulating materials are superposed in any other configuration as needed or desired for a particular application. Thus, for example, an insulating material may be superposed with one or more additional layers of susceptors or susceptor films.

While various examples of constructs are provided herein, it will be understood that any configuration of components may be used as needed or desired. The construct may be flexible, semi-rigid, rigid, or may include a variety of components having different degrees of flexibility. Additionally, it should be understood that the present invention contemplates constructs for single-serving portions and for multiple-serving portions. It also should be understood that various components used to form the constructs of the present invention may be interchanged. Thus, while only certain combinations are illustrated herein, numerous other combinations and configurations are contemplated hereby.

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention and to provide the best mode contemplated by the inventor or inventors of carrying out the invention. The detailed description set forth herein is not intended nor is to be construed to limit the present invention or otherwise to exclude any such other embodiments, adaptations, variations, modifications, and equivalent arrangements of the present invention.

What is claimed is:

1. A multi-use construct, comprising:

a base including microwave energy interactive material operative for converting microwave energy into heat; and a plurality of walls defining an interior space adjacent to the base, wherein the base includes a line of disruption that defines a removable portion of the base, the line of disruption being substantially circular in shape and distal from the walls, and a peripheral portion of the base extending from the line of disruption to the walls, wherein the construct is for being transitioned between a first configuration with the walls extending upwardly from the base, so that the construct is for containing a food item within the interior space with the food item at least partially seated on the removable portion and the peripheral portion of the base, and a second configuration with the removable portion separated from the base, so that the removable portion is for underlying the food item, and with the walls extending downwardly from the base, so that the peripheral portion of the base is for overlying the food item.

2. The construct of claim 1, wherein in the second configuration, the microwave energy interactive material of the removable portion is for being adjacent to a bottom surface of the food item and the microwave energy interactive material of the peripheral portion of the base is for being adjacent to an upper peripheral surface of the food item, wherein the bottom surface and upper peripheral surface of the food item are desirably at least one of browned and crisped.

3. The construct of claim 1, further comprising a cut adjacent to the line of disruption, wherein the cut defines a tab.

4. The construct of claim 1, wherein the microwave energy interactive material of the base circumscribes a plurality of microwave energy transparent areas.

5. The construct of claim 4, wherein the microwave energy transparent areas are concentrated within a central area of the base.

6. The construct of claim 1, wherein the removable portion of the base includes a plurality of score lines.

7. The construct of claim 6, wherein the score lines extend radially from a central area of the base.

8. The construct of claim 1, wherein the plurality of walls includes a first plurality of walls and a second plurality of walls, wherein the first plurality of walls includes locking tabs and the second plurality of walls includes receiving slits for engaging the locking tabs.

9. The construct of claim 8, further comprising cutouts disposed between the locking tabs and the second plurality of walls.

10. The construct of claim 1, wherein the plurality of walls includes a first plurality of walls and a second plurality of walls, and the first plurality of walls include end panels for being joined to the second plurality of walls.

11. The construct of claim 1, wherein the base is substantially square in shape, and the plurality of walls includes a first pair of walls opposite one another and a second pair of walls opposite one another.

12. The construct of claim 1, wherein the base is substantially octagonal in shape, and the plurality of walls includes a first plurality of walls and a second plurality of walls, wherein the walls of the first plurality of walls and the walls of the second plurality of walls are in an alternating configuration.

13. The construct of claim 1, in combination with a food item having a bottom surface and an upper peripheral surface that are desirably at least one of browned and crisped.

14. A method of using the combination of claim 13, comprising:

transitioning the construct between the first configuration and the second configuration, wherein transitioning the construct between the first configuration and the second configuration comprises separating the removable portion from the base, positioning the food item on the removable portion so that the removable portion underlies the food item, and positioning the peripheral portion of the base over the food item with the walls extending downwardly from the base.

15. The method of claim 14, wherein in the second configuration, the removable portion of the base is adjacent to the bottom surface of the food item and the peripheral portion of the base is adjacent to the upper peripheral surface of the food item, and the method further comprises exposing the food item on the construct to microwave energy so that the bottom surface of the food item and the upper peripheral surface of the food item are at least one of browned and crisped.

16. A multi-use construct, in combination with a food item having a bottom and a periphery that are desirably at least one of browned and crisped, the construct comprising:

a base including microwave energy interactive material operative for converting microwave energy into heat, the heat being for at least one of browning and crisping the bottom and periphery of the food item; and a plurality of walls defining an interior space adjacent to the base, wherein the base includes a line of disruption that defines a removable portion of the base, the line of disruption being substantially circular in shape and distal from the walls, and a peripheral portion of the base extending around the removable portion, wherein in a first configuration, the walls extend upwardly from the base, and the food item is seated on at least one of the removable portion and the peripheral portion of the base within the interior space, in a second configuration, the removable portion is separated from the base, and the removable portion of the base underlies the bottom of the food item, and in a third configuration, the removable portion is separated from the base and the peripheral portion of the base overlies the periphery of the food item with the walls extending downwardly from the base.

17. The combination of claim 16, wherein, in a fourth configuration, the removable portion is separated from the base and underlies the bottom of the food item, so that the microwave energy interactive material of the removable portion is adjacent to the bottom of food item, and the peripheral portion of the base overlies the periphery of the food item with the walls extending downwardly from the base, so that the microwave energy interactive material of the peripheral portion is adjacent to the periphery of the food item.

18. The combination of claim 16, wherein the microwave energy interactive material of the base includes a plurality of microwave energy transparent areas.

19. The combination of claim 18, wherein the microwave energy transparent areas are concentrated within a central area of the base.

20. The combination of claim 18, wherein the removable portion of the base includes a plurality of score lines.

21. The combination of claim 20, wherein the score lines extend radially from a central area of the base.

22. The combination of claim 16, wherein the base is substantially square in shape or substantially octagonal in shape.

23. A method of using the combination of claim 16, comprising:

transitioning the construct between the first configuration and the second configuration, wherein transitioning the construct between the first configuration and the second configuration comprises separating the removable portion from the base, and positioning the food item on the removable portion of the base so that the microwave energy interactive material of the removable portion is adjacent to the bottom of the food item;

transitioning the construct between the second configuration and the third configuration, wherein transitioning the construct between the second configuration and the third configuration comprises positioning the peripheral portion of the base over the food item with the walls extending downwardly from the base so that the microwave energy interactive material of the peripheral portion of the base is adjacent to the periphery of the food item; and exposing the food item on the construct to microwave energy so that the bottom and the periphery of the food item are at least one of browned and crisped.

24. The method of claim 23, wherein separating the removable portion from the base defines an opening in the base, and in the third configuration, the opening overlies a portion of the food item not intended to be browned or crisped.

* * * * *